US011071386B2

(12) United States Patent
Cvek

(10) Patent No.: US 11,071,386 B2
(45) **Date of Patent: *Jul. 27, 2021**

(54) SEAT PIVOTING MECHANISM AND CHAIR HEIGHT LOCKING SYSTEM

(71) Applicant: Sava Cvek, Jamaica Plain, MA (US)

(72) Inventor: Sava Cvek, Jamaica Plain, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/619,427

(22) Filed: Jun. 9, 2017

(65) Prior Publication Data

US 2018/0184810 A1 Jul. 5, 2018

Related U.S. Application Data

(60) Provisional application No. 62/348,136, filed on Jun. 9, 2016.

(51) Int. Cl.

| | |
|---|---|
| ***A47C 1/032*** | (2006.01) |
| ***A47C 3/30*** | (2006.01) |
| ***A47C 7/44*** | (2006.01) |

(52) U.S. Cl.

CPC ..... *A47C 1/03222* (2013.01); *A47C 1/03255* (2013.01); *A47C 1/03272* (2013.01); *A47C 3/30* (2013.01); *A47C 7/441* (2013.01); *A47C 7/443* (2013.01)

(58) Field of Classification Search

None

See application file for complete search history.

(56) References Cited

U.S. PATENT DOCUMENTS

| | | | | |
|---|---|---|---|---|
| 1,336,510 | A | | 4/1920 | Collier |
| 1,836,630 | A | | 12/1931 | Thum |
| 2,018,825 | A | | 10/1935 | Wood |
| 2,410,871 | A | | 11/1946 | Fields et al. |
| 2,615,496 | A | | 10/1952 | Lorenz |
| 2,819,911 | A | | 1/1958 | Syak |
| 2,838,095 | A | | 6/1958 | Deaton |
| 2,901,027 | A | | 8/1959 | Dickson |
| 3,369,840 | A | | 2/1968 | Dufton |
| 3,740,792 | A | | 6/1973 | Werner |
| 3,741,607 | A | | 6/1973 | Cramer |
| 3,914,844 | A | * | 10/1975 | Norwood ..... B25B 27/026 29/235 |
| 4,345,733 | A | | 8/1982 | Ambasz et al. |

(Continued)

*Primary Examiner* — David E Allred

(74) *Attorney, Agent, or Firm* — Thomas P. O'Connell; O'Connell Law Firm

(57) ABSTRACT

A pivoting mechanism with a first member, a second member pivotally engaged with the first member to pivot about a pivot axis, and pivoting resistance mechanism with a spring housing disposed in the first member spaced from the pivot axis, a spring disposed in the spring housing, and a deflecting member that projects from the second member spaced from the pivot axis to engage the spring disposed in the spring housing. The first member can be a chair mechanism body, and the second member can be a pivoting support, such as for a chair bottom or back. A height adjustment mechanism has a movable member, and a locking member, such as a screw, can be operative as a height locking mechanism with a first, restraining condition wherein actuation of the movable member is prevented and a second, non-restraining condition wherein actuation of the movable member is permitted.

13 Claims, 32 Drawing Sheets

(56) References Cited

U.S. PATENT DOCUMENTS 4,709,962 A 12/1987 Steinmann
4,761,033 A 8/1988 Lanuzzi
4,854,641 A 8/1989 Reineman
5,026,117 A 6/1991 Faiks et al.
5,042,876 A 8/1991 Faiks
5,080,318 A 1/1992 Takamatsu
5,160,184 A 11/1992 Faiks et al.
5,328,237 A 7/1994 Yamaguchi et al.
5,347,903 A * 9/1994 Stolzer ..... B23D 53/04 83/796
5,356,199 A 10/1994 Elzenbeck
5,375,912 A 12/1994 Stulik et al.
5,725,276 A 3/1998 Ginat
5,772,282 A 6/1998 Stumpf
5,806,828 A * 9/1998 Rothe ..... A47C 3/18 248/631
5,806,937 A * 9/1998 Brunson ..... B60T 7/20 188/34
5,839,719 A * 11/1998 Hosan ..... F16F 9/368 267/64.12
5,979,984 A 11/1999 DeKraker et al.
6,039,397 A 3/2000 Ginat
6,276,755 B1 * 8/2001 Su ..... A47C 1/03255 297/285
6,386,634 B1 3/2002 Stumpf
6,709,056 B2 3/2004 Bock
6,709,058 B1 3/2004 Diffrient
6,959,965 B2 11/2005 Diffrient
6,966,604 B2 11/2005 Stumpf
7,461,897 B2 12/2008 Kruse et al.
7,490,902 B2 2/2009 Aubert
7,806,478 B1 10/2010 Cvek
7,828,756 B2 11/2010 Kamba et al.
7,850,237 B2 12/2010 Gorgi
8,146,990 B2 4/2012 Bock
8,714,645 B2 * 5/2014 Cvek ..... A47C 3/026 297/301.4
2005/0052061 A1 3/2005 Deimen et al.
2005/0062323 A1 3/2005 Dicks
2005/0275265 A1 12/2005 Deimen
2006/0130808 A1 * 6/2006 Steffes ..... F02D 31/002 123/376
2006/0130809 A1 * 6/2006 Wetor ..... F02D 31/002 123/376
2006/0202529 A1 * 9/2006 Johnson ..... A47C 1/03238 297/286
2007/0057553 A1 * 3/2007 Roslund ..... A47C 1/03266 297/300.2
2008/0030053 A1 2/2008 Kamba et al.
2010/0051400 A1 * 3/2010 Yang ..... B60T 7/102 188/344
2012/0007341 A1 * 1/2012 Masaki ..... A61G 5/0825 280/650
2013/0127219 A1 * 5/2013 Gerwig ..... A47C 1/03261 297/284.3

* cited by examiner

SEAT PIVOTING MECHANISM AND CHAIR HEIGHT LOCKING SYSTEM

RELATED APPLICATION

This application claims priority to U.S. Provisional Patent Application No. 62/348,136, filed Jun. 9, 2016, which is incorporated herein by reference.

FIELD OF THE INVENTION

The present invention relates generally to chairs. More particularly, disclosed herein are compact pivoting mechanisms for task chairs and locking systems for selectively fixing height-adjustable chairs at preferred heights.

BACKGROUND OF THE INVENTION

Numerous chair designs have been proposed with back and potentially seat and arm structures retained to pivot in relation to a chair base by a pivoting mechanism. Those pivoting mechanisms are typically bulky and complicated and do not have a pivot axis within a desirable range of the center of gravity of the typical seat occupant.

The present inventor has also recognized that, while height adjustment capabilities in task chairs can prove to be an invaluable feature, there are circumstances where further height adjustment away from a preferred height is undesirable. For instance, in a conference room, the host will typically seek to have all chairs adjusted to an identical height, perhaps for aesthetically pleasing symmetry or perhaps to permit the chairs to be pushed under the conference table without damage to the table or the chair. However, individual users will often adjust the chair height to their individual preferences. As a result, the once orderly and symmetrical conference room can quickly become disheveled in appearance, and ill-fitting chairs can cause highly undesirable damage to valuable chairs and tables.

The present inventor has thus appreciated that there is a continuing need for a pivoting mechanism that is exceedingly compact and efficient in structure and, potentially, that pivots about a preferred pivot axis location based on the center of gravity of expected seat occupants. The inventor has further appreciated that there is a need for a system for selectively fixing height-adjustable chairs, once adjusted to a preferred height, against height adjustment.

SUMMARY OF THE INVENTION

Accordingly, the present invention has as an object thereof the provision of a pivoting mechanism for task chairs and other articles that is compact and efficient in structure.

A further object of embodiments of the invention is to provide a pivoting mechanism that permits pivoting of a seat back and, additionally or alternatively, a seat bottom about a preferred pivot axis established in view of the projected center of gravity of prospective users of the chair.

An object of embodiments of the invention is to provide a system for selectively fixing height-adjustable chairs, once adjusted to a preferred height, against further height adjustment.

These and in all likelihood further objects and advantages of the present invention will become obvious not only to one who reviews the present specification and drawings but also to those who have an opportunity to experience an embodiment of the pivoting mechanism or the chair height locking system disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more objects of the invention, a pivoting mechanism can comprise a first member, and a second member pivotally engaged with the first member to pivot about a pivot axis. A first pivoting resistance mechanism is operative to provide resistance to a pivoting of the first member relative to the second member. That first pivoting resistance mechanism can have a spring housing disposed in the first member spaced from the pivot axis, a spring disposed in the spring housing, and a deflecting member that projects from the second member spaced from the pivot axis to engage the spring disposed in the spring housing.

The spring can, by way of example and not limitation, be a compression spring or any other resiliently compressible or extendable member. The spring housing can be considered to have a longitudinal, and the longitudinal of the spring housing can be generally orthogonal to the pivot axis.

As disclosed herein, the first member or the second member can be a mechanism body for a chair, and the other of the first member and the second member can be a first pivoting support. Under such constructions, the mechanism body can have a central hub and first and second arms that project from the central hub, and the pivoting support can be pivotally engaged with the first arm. A chair exploiting the pivoting mechanism can thus have a chair bottom, a chair back, and the pivoting mechanism taught herein.

A second pivoting support can be pivotally engaged with the mechanism body to pivot about a pivot axis, and a second pivoting resistance mechanism can provide resistance to a pivoting of the pivoting support relative to the mechanism body. The second pivoting resistance mechanism can, for example, comprise a spring housing disposed in the mechanism body or the pivoting support spaced from the pivot axis, a spring disposed in the spring housing, and a deflecting member that projects from the other of the mechanism body and the pivoting support spaced from the pivot axis to engage the spring disposed in the spring housing. It is further contemplated that the first and second pivoting supports can pivot about a pivot hub, and a longitudinal channel can be disposed in each spring housing for receiving and permitting a movement of the deflecting member.

In further embodiments, the first member or the second member can again comprise a mechanism body, and the other of the first member and the second member can comprise a shaft pivotally retained by the mechanism body. The shaft can have one or more output portions, such as distal ends of the shaft, for outputting the pivoting resistance of the shaft to, for example, a seat bottom or a seat back. The mechanism body can comprise a mechanism body for a chair. A left support can then be retained by the shaft to pivot relative to the mechanism body, and a right support can be retained by the shaft to pivot relative to the mechanism body. Moreover, in embodiments of the pivoting mechanism, the deflecting member can be a spring pivot pin that projects radially from the shaft to have a distal portion engaging the spring. Further, with the spring housings considered to have longitudinal, the shaft can be received through the mechanism body to be generally orthogonal to the longitudinals of the spring housings.

Additionally or alternatively, a chair as taught herein can have a chair bottom, a chair back, a chair base, a height adjustment mechanism comprising a movable member for selectively permitting an adjustment of a height of at least one of the chair bottom and the chair back in relation to the chair base, and a height locking mechanism. The height locking mechanism can comprise a locking member with a first, restraining condition wherein actuation of the movable member is prevented and a second, non-restraining condition wherein actuation of the movable member is permitted. The locking member can, by way of example, comprise a screw threadedly engaged with a chair mechanism body to be extendable and retractable between the first, restraining condition and the second, non-restraining condition.

As taught herein, the chair can thus further include a mechanism body, and the movable member can be movably retained by the mechanism body. For instance, the movable member can take the form of a pivotable lever with a first end comprising a handle, a second end comprising a tip, and a pivot axis between the first and second ends. In such embodiments, the height adjustment mechanism can further comprise an extendable and retractable cylinder, such as a pneumatic or hydraulic cylinder. The tip of the pivotable lever can then be operable to actuate selective extension and retraction of the cylinder when the locking member is in the second, non-restraining condition. In certain embodiments, the locking member can be extendable to engage the pivotable lever between the tip and the pivot axis.

The locking member, which again can take the form of a screw, can be threadedly retained in relation to a retaining portion fixed to the mechanism body. The retaining portion fixed to the mechanism body could comprise a portion of the mechanism body itself, a retaining plate fixed to the mechanism body, or some other retaining portion.

Still further, it is taught herein that a protuberance, such as a safety washer or some other protuberating formation, can be retained by the locking member, and that protuberance can be operative to prevent over-retraction of the locking member. For instance, the protuberance can be fixedly retained by the locking member between a tip of the locking member and a surface of the retaining portion fixed to the mechanism body. Still further, to prevent excess displacement of the pivotable lever or other movable member, the locking member can have a shoulder, and the retaining portion fixed to the mechanism body can have a shoulder for contacting the shoulder of the locking member when the locking member is extended.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The compact pivoting mechanisms for task chairs and locking systems for selectively fixing height-adjustable chairs at preferred heights disclosed herein are subject to a wide variety of embodiments. However, to ensure that one skilled in the art will be able to understand and, in appropriate cases, practice the present invention, certain preferred embodiments of the broader inventions revealed herein are described below and shown in the accompanying drawing figures.

The pivoting mechanism disclosed herein is commonly depicted as being employed relative to a chair, and that application has been found to produce a chair construction that is particularly advantageous in structure and function. However, it is to be understood that the pivoting mechanisms could be employed in other applications within the scope of the invention except as it may be expressly limited. Therefore, before any particular embodiment of the invention is explained in detail, it must be made clear that the following details of construction and illustrations of inventive concepts are mere examples of the many possible manifestations of the invention.

Figure 1:
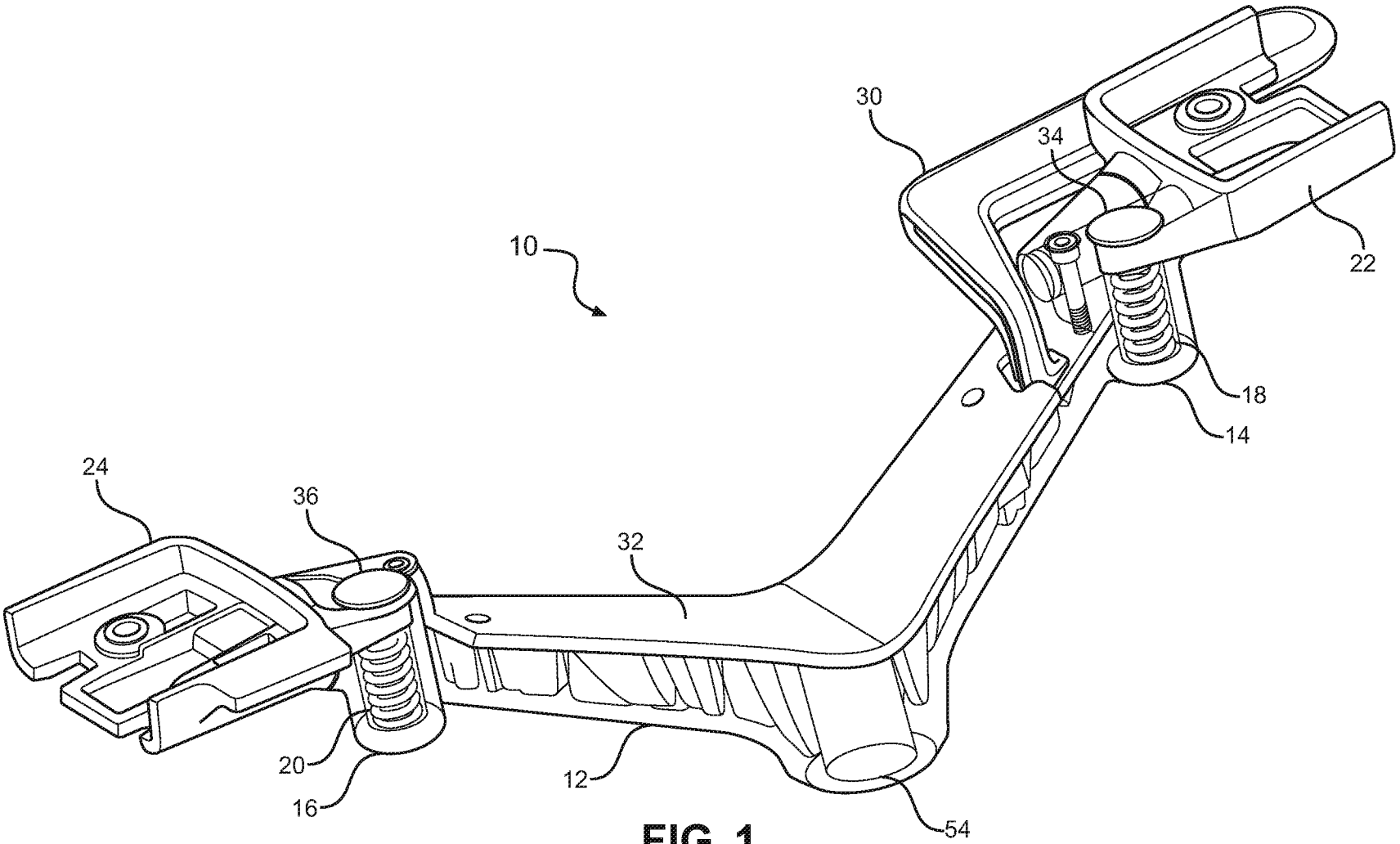
FIG. 1 is a partially sectioned perspective view of a pivoting mechanism according to the present invention.
Figure 2A:
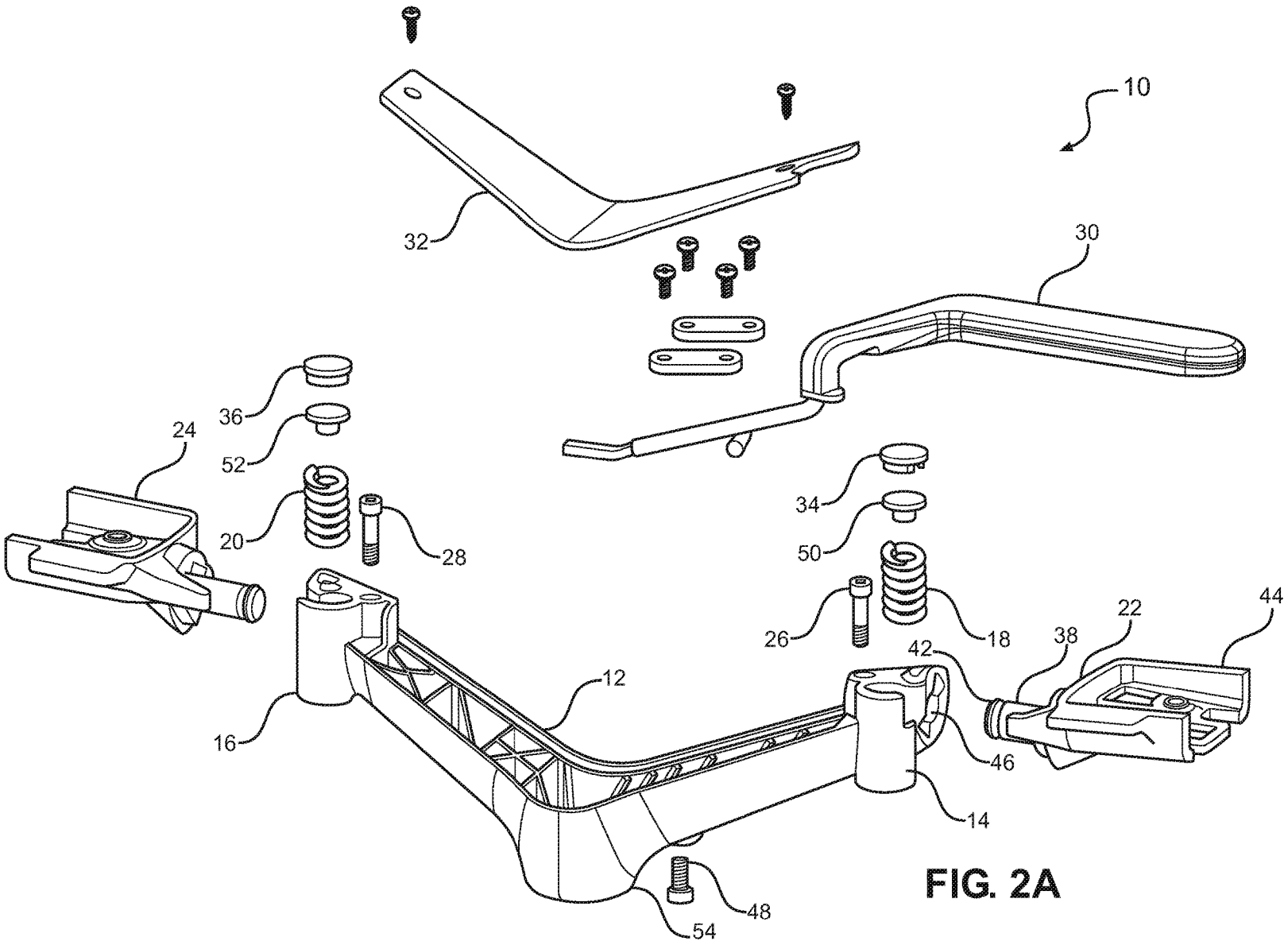
FIG. 2A is an exploded perspective view of the pivoting mechanism of FIG. 1.
Figure 2B:
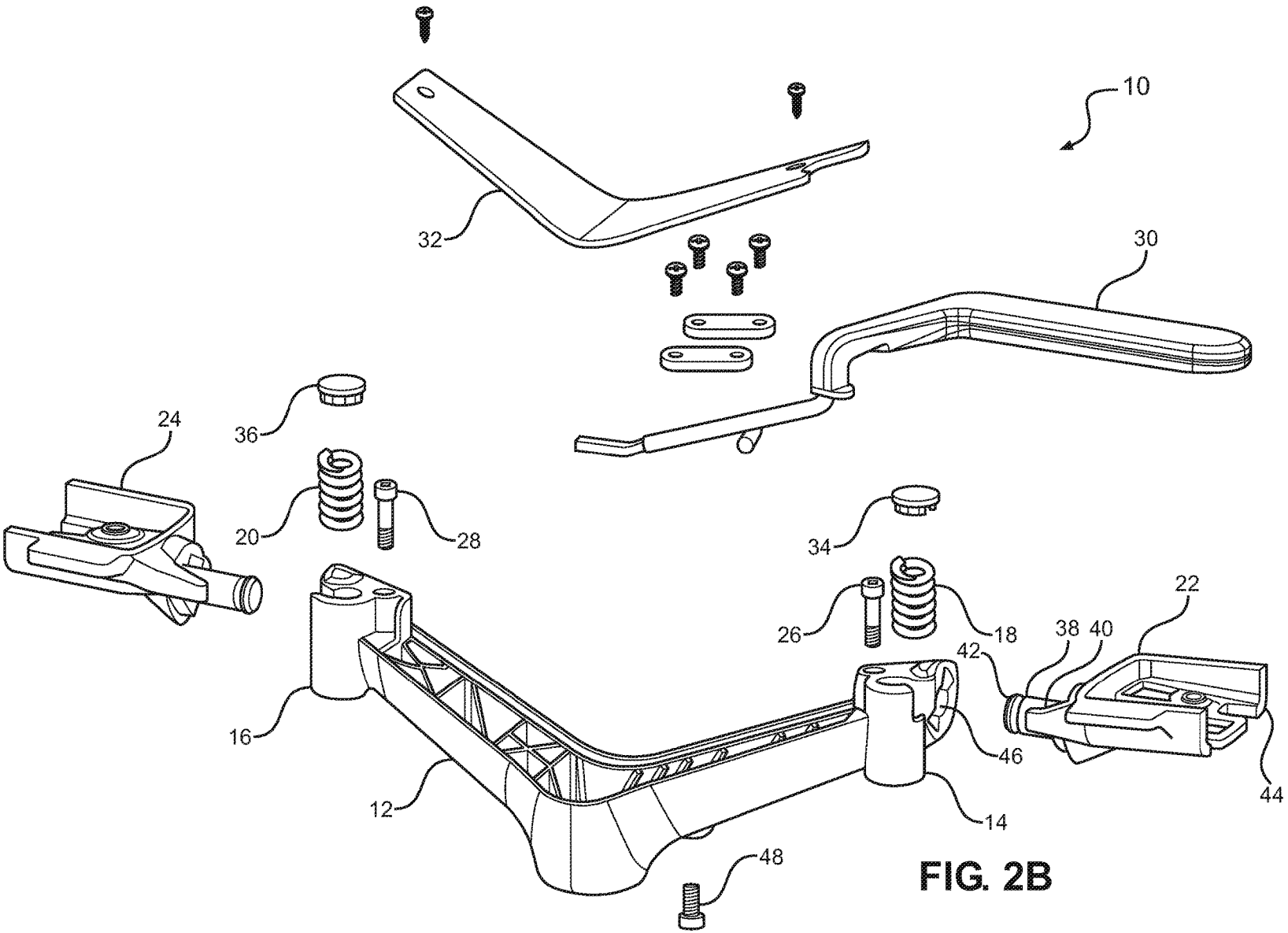
FIG. 2B is a further exploded perspective view of the pivoting mechanism of FIG. 1.
Figure 3:
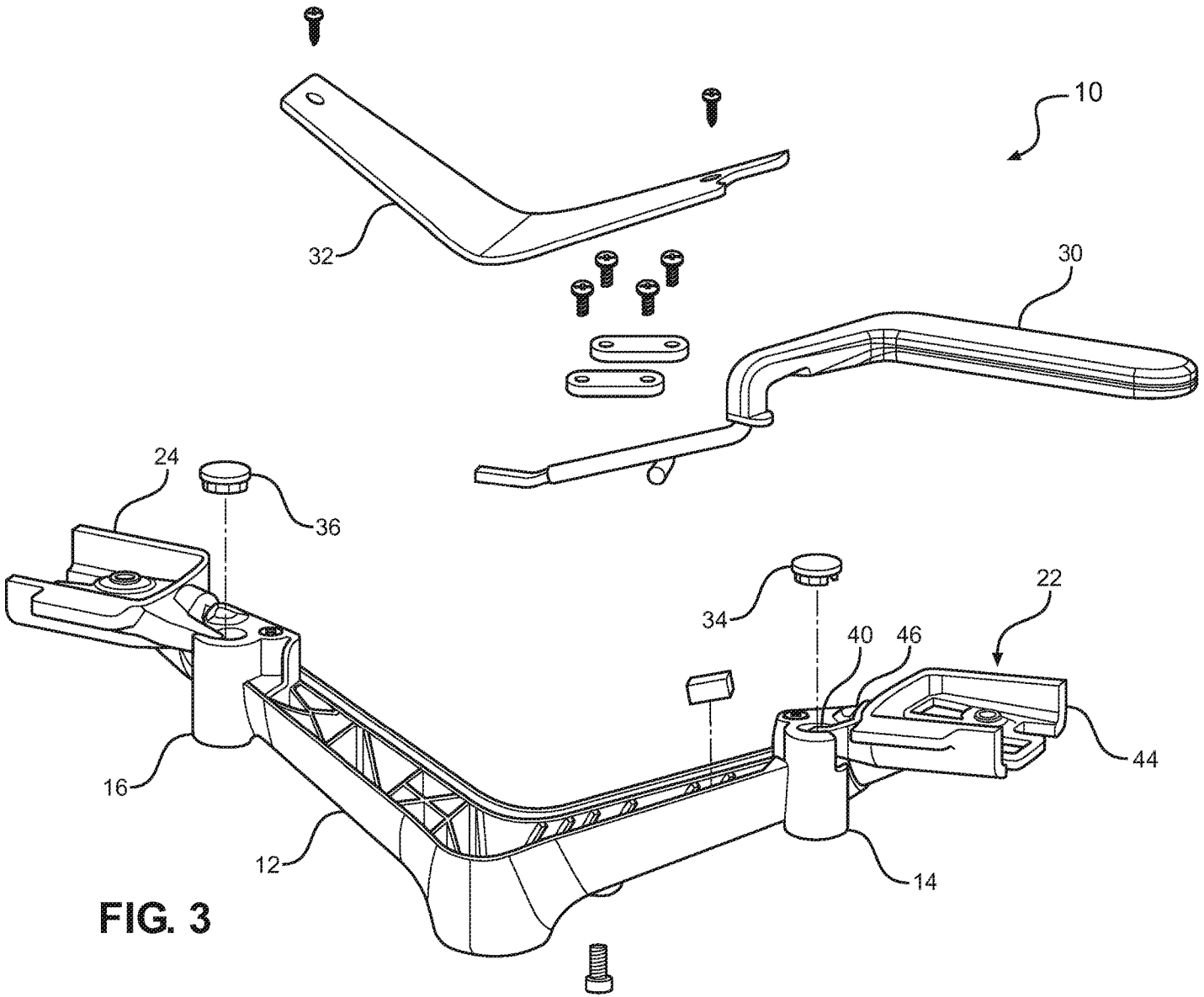
FIG. 3 is a partially exploded perspective view of the pivoting mechanism of FIG. 1.

Turning more particularly to the drawings, an embodiment of a pivoting mechanism according to the invention is indicated generally at 10 in FIGS. 1 through 3. There, the pivoting mechanism 10 is founded on a mechanism body 12 that has first and second arms that project from a central hub 54. In use, the central hub 54 would typically receive a support rod of a chair base 204 as shown in FIG. 18 through 23, for instance. A first spring housing 14 is disposed at a distal end of the first arm, and a second spring housing 16 is disposed at a distal end of the second arm. In the depicted embodiment, the spring housings 14 and 16 are cylindrical. A first compression spring 18 is received in the first spring housing 14, and a second compression spring 20 is received in the second spring housing 16.

A pivot receiver aperture 46 is also disposed in the distal end of each arm. The centers of the receiver apertures 46 are spaced a given distance from the centers of the spring housings 14 and 16. Here, the spring housings 14 and 16 have longitudinal axes that are disposed generally vertically, and the pivot receiver apertures 46 have axes that project generally laterally such that the axes of the spring housings 14 and 16 and the pivot receiver apertures 46 are generally orthogonal.

A right support 22 is pivotally engaged with the pivot receiver aperture 46 disposed at the end of the first arm, and a left support 24 is pivotally engaged with the pivot receiver aperture 46 disposed at the end of the second arm. More particularly, each support 22 and 24 has a pivot hub 38, which here comprises a rod, that projects from a mount 44, and the pivot hubs 38 are matingly received into the pivot receiver apertures 46 whereby the supports 22 and 24 can pivot in relation to the arms of the mechanism body 12.

In practice and as is shown and described herein, the supports 22 and 24 can be employed to pivotally support chair components, such as one or more of a chair bottom, a chair back, and chair arms as shown in FIGS. 18 through 23, for example. In certain embodiments of the invention as is illustrated, the mounts 44 can have laterally disposed channels therein for receiving the bases of chair arms and, with the bases of the chair arms so received, a chair bottom and/or chair back can be additionally affixed to the mount 44 to pivot therewith.

The depicted supports 22 and 24 and the pivot receiver apertures 46 have pivot limiting formations that permit pivoting of the supports 22 and 24 relative to the mechanism body 12 over a give range of angular pivoting. Here, formations on the supports 22 and 24 concentric with the pivot hubs 38 engage with corresponding formations in the apertures 46 on the mechanism body 12 to form a butterfly joint, which permits pivoting of the supports 22 and 24 over a given degree of angular rotation.

As seen, for instance, in FIGS. 2A and 2B, the pivot hubs 38 have annular retaining channels 42 formed therein, and stop screws 26 and 28 are received through corresponding boreholes in the mechanism body 12 to engage the retaining channels 42 along a tangent thereto. With this, the pivot hubs 38 and the supports 22 and 24 are retained against displacement relative to the mechanism body 12 while permitting ready pivoting of the supports 22 and 24.

Eccentric deflecting members 40 project from the mounts 44 of the supports 22 and 24 oriented generally in alignment with the pivot hubs 38. The deflecting members 40 are disposed eccentric to the pivot hubs 38 by approximately the distance between the centers of the pivot receiver apertures 46 and the first and second spring housings 14 and 16. Each spring housing 14 and 16 has a longitudinal channel therein for receiving the deflecting members 40 to permit arcuate movement thereof during a pivoting of the supports 22 and 24. The deflecting members 40 are thus disposed to engage distal ends of the first and second springs 18 and 20 when the pivot mechanism 10 is assembled as in FIGS. 1, 4A, and 5. Rigid spring pivots 50 and 52 have tubular portions received into the ends of the springs 18 and 20 and cap portions that sit atop the springs 18 and 20. The cap portions of the spring pivots 50 and 52 are interposed between the deflecting members 40 and the distal ends of the springs 18 and 20 to facilitate reliable movement of the deflecting members 40 and compression of the springs 18 and 20. Spring dust caps 34 and 36 can cap the spring housings 14 and 16. A cover 32 can close the mechanism body 12.

A height adjustment lever 30 is pivotally retained by the mechanism body 12. The height adjustment lever 30 has a tip thereof selectively operable to actuate a height adjustment mechanism, such as a pneumatic cylinder as is indicated at 114 in FIG. 16. The pneumatic cylinder 114 is received into the central hub 54 for permitting height adjustment of the mechanism body 12 and a retained seat bottom, seat back, and, additionally or alternatively, seat arms. As is shown and described below, a height stop screw 48 can be selectively engaged with the height adjustment lever 30 to prevent pivoting of the height adjustment lever 30 and actuation of the height adjustment mechanism 114 thereby to fix the retained components of a given chair at a selected height.

Figure 4A:
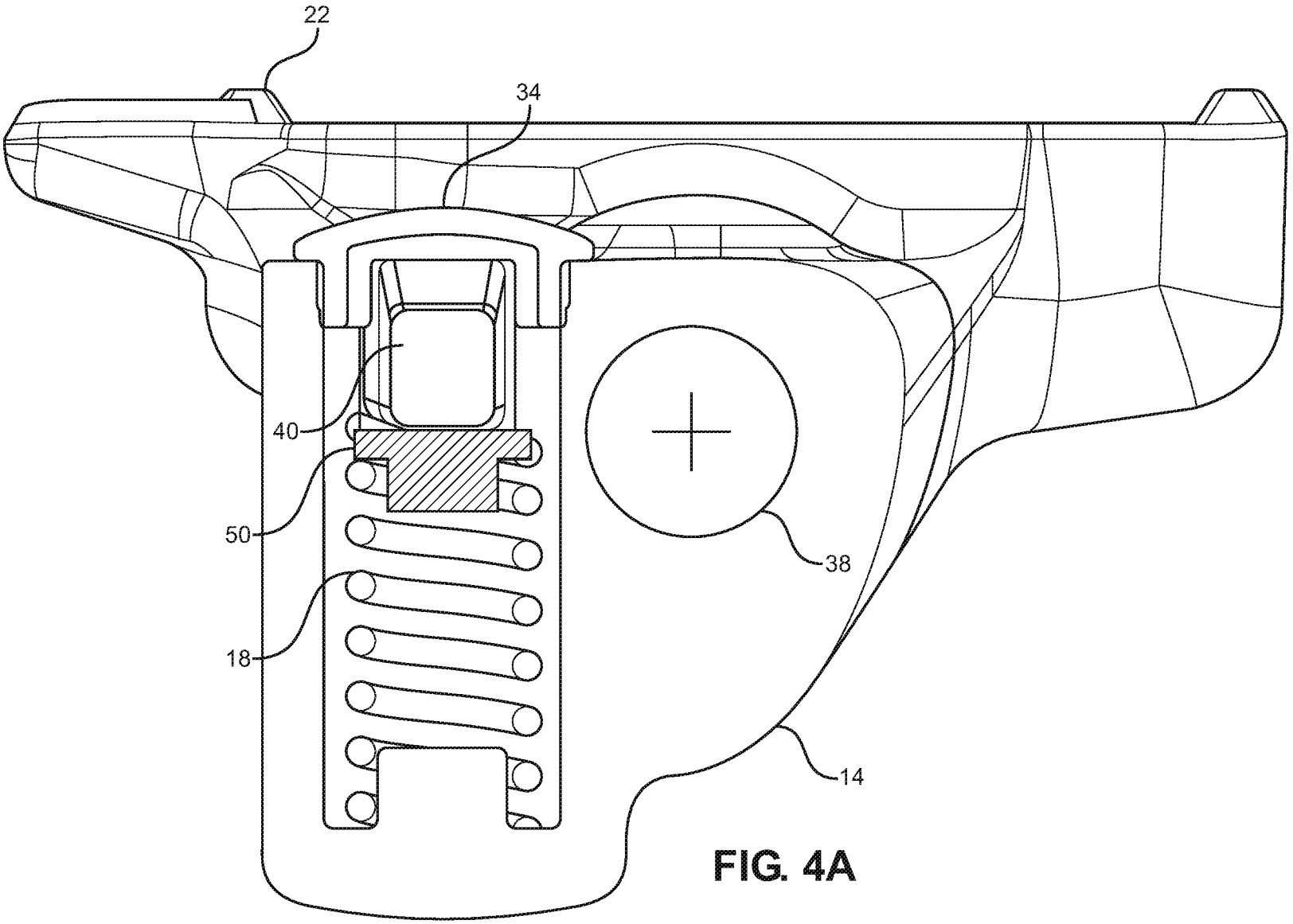
FIG. 4A is a cross sectional view of the pivoting mechanism of FIG. 1 in a non-pivoted configuration.
Figure 4B:
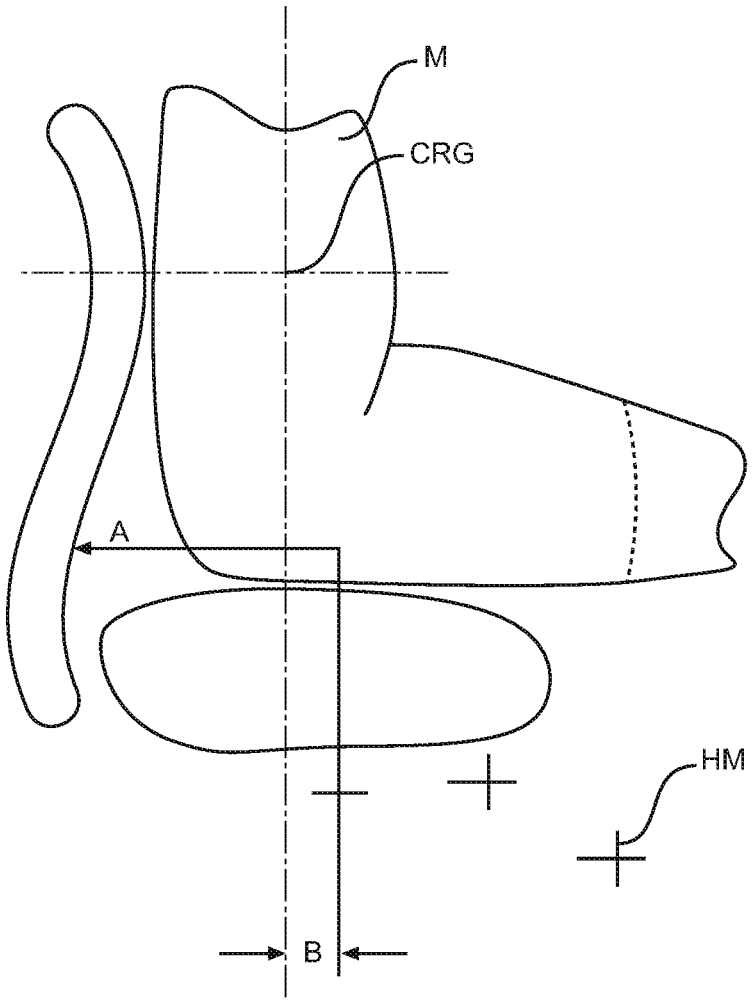
FIG. 4B is a schematic view in side elevation of a possible pivot axis configuration for the pivoting mechanism disclosed herein.
Figure 5:
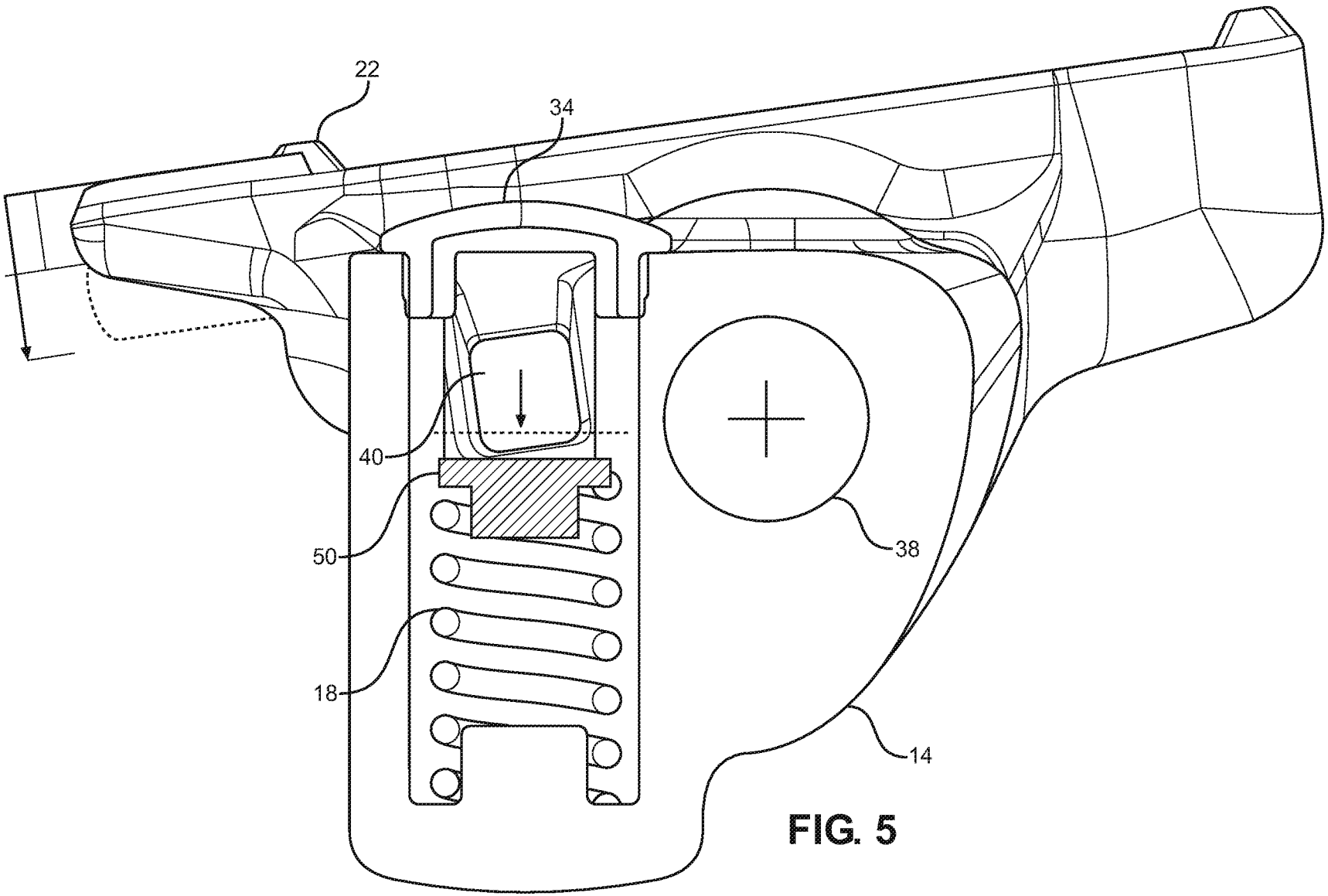
FIG. 5 is a cross sectional view of the pivoting mechanism of FIG. 1 in a pivoted configuration.

When the pivoting mechanism 10 is assembled as in FIGS. 1, 4A, and 5, the deflecting members 40 engage the distal ends of the springs 18 and 20 with the spring pivots 50 and 52 therebetween. A pivoting of the supports 22 and 24 and thus a chair back, bottom, and/or arms will be resisted by the springs 18 and 20 as the deflecting members 40 effectively press on the distal ends of the springs 18 and 20 through the spring pivots 50 and 52 to tend to compress the springs 18 and 20, such as from the uncompressed condition of FIG. 4A to the compressed, pivoted condition of FIG. 5. As is described further hereinbelow and as is illustrated in FIG. 4B, the compact configuration of the disclosed pivoting mechanism 10 permits a pivot axis within a preferred distance of the projected relative center of gravity (CRG) of an expected occupant of a chair making use of the pivoting mechanism 10.

Figure 6:
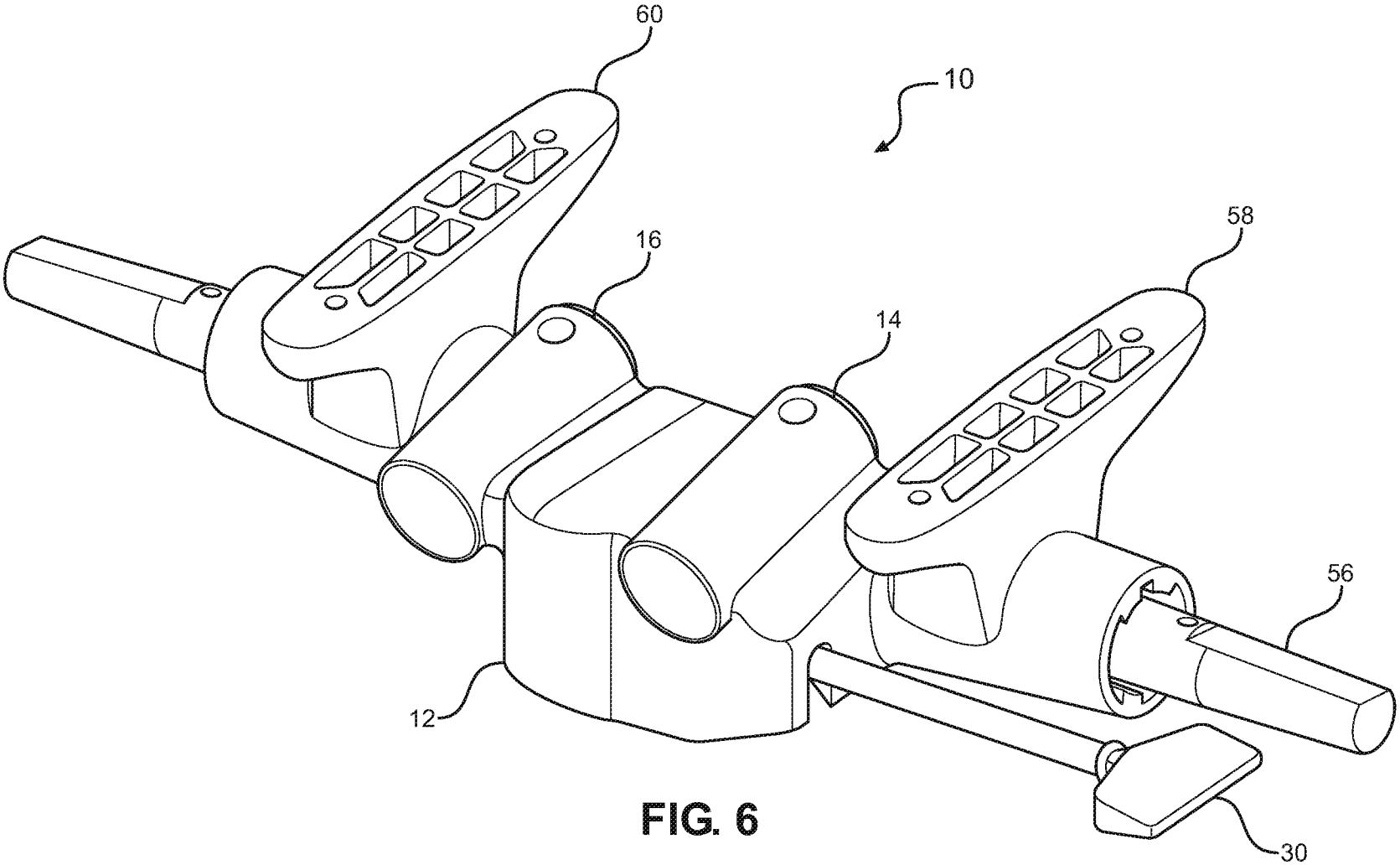
FIG. 6 is a perspective view of an alternative pivoting mechanism according to the invention.
Figure 7A:
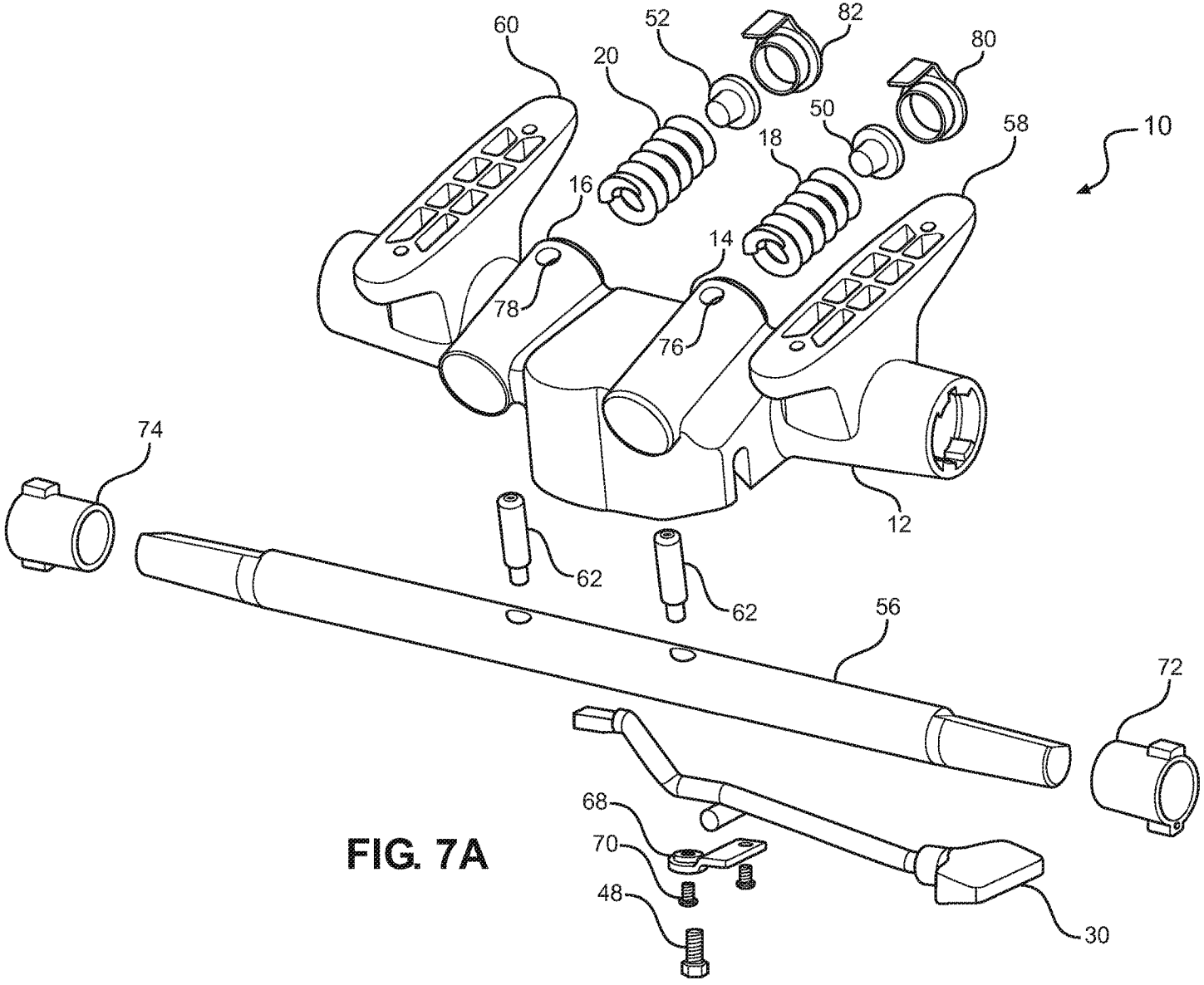
FIG. 7A is an exploded perspective view of the pivoting mechanism of FIG. 6.
Figure 7B:
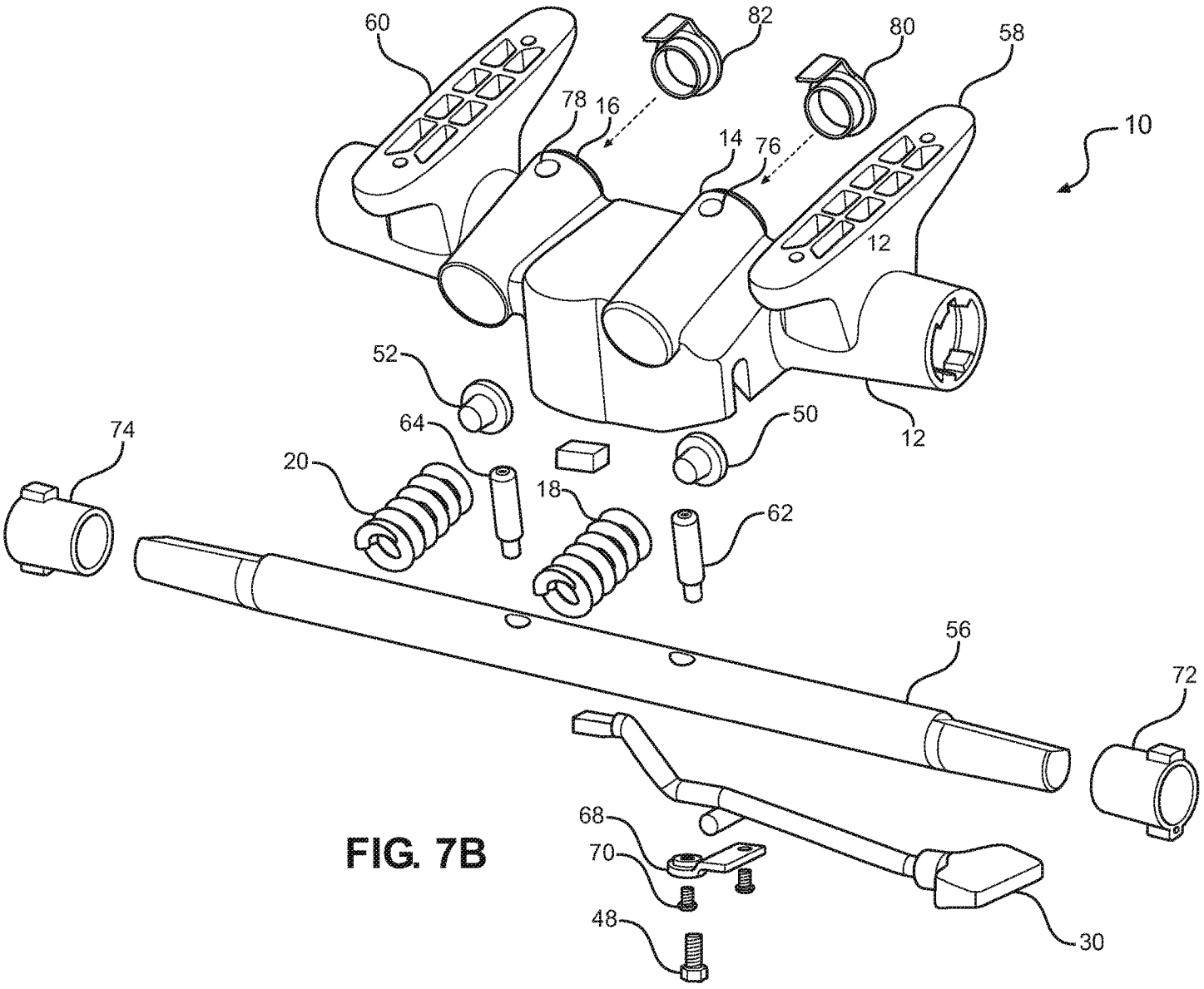
FIG. 7B is a further exploded perspective view of the pivoting mechanism of FIG. 6.
Figure 8:
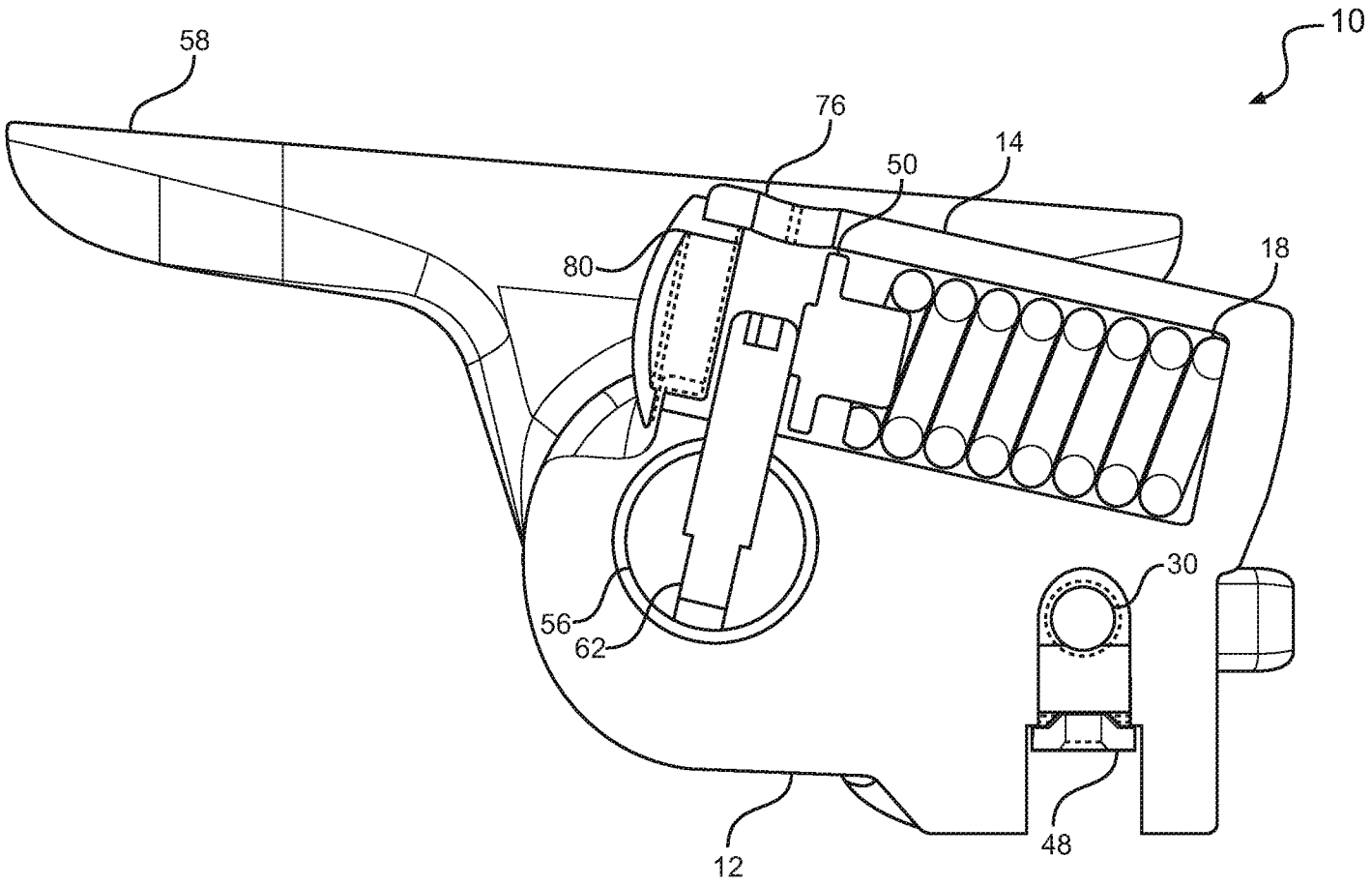
FIG. 8 is a cross sectional view of the pivoting mechanism of FIG. 6 in a non-pivoted configuration.

An alternative embodiment of the pivoting mechanism 10 is depicted in FIGS. 6 through 8. There, the mechanism body 12 again has first and second spring housings 14 and 16 that receive first and second springs 18 and 20 respectively. Spring pivots 50 and 52 are again disposed with cap portions that overlie distal ends of the springs 18 and 20. Dust caps 80 and 82 seal off the spring housings 14 and 16 and have retaining fingers that engage apertures 76 and 78 in the spring housings 14 and 16. First and second mounts 58 and 60 are fixed to the mechanism body 12, such as by being formed therewith to permit engagement with and retention of a seat bottom.

Here, however, the pivoting resistance of the springs 18 and 20 is employed to resist pivoting of a shaft 56. The shaft 56 has a first spring pivot pin 62 that projects radially from the shaft 56 to have a distal portion thereof overlie the spring pivot 50 and the first spring 18 and a second spring pivot pin 64 that projects radially from the shaft 56 to have a distal portion thereof overlie the spring pivot 52 and the second spring 20. The shaft 56 is received through the mechanism body 12 to be generally orthogonal to the longitudinals or axes of the spring housings 14 and 16 and the retained springs 18 and 20. Keyed bushings 72 and 74 cooperate to maintain the shaft 56 in a centered configuration. With this, a rotation of the shaft 56 will produce a pivoting of the spring pivot pins 62 and 64, and the pivoting of the spring pivot pins 62 and 64 will produce a compression of the springs 18 and 20 whereby pivoting of the shaft 56 will be resisted by the springs 18 and 20. The ends of the shaft 56 project from the mechanism body 12 and output rotation resistance of the shaft 56 to a seat back, a seat bottom, seat arms, or any combination thereof as is taught, for instance, herein and in the present inventor's U.S. Pat. Nos. 8,602,494 and 8,714,645, which are incorporated herein by reference.

Figure 9:
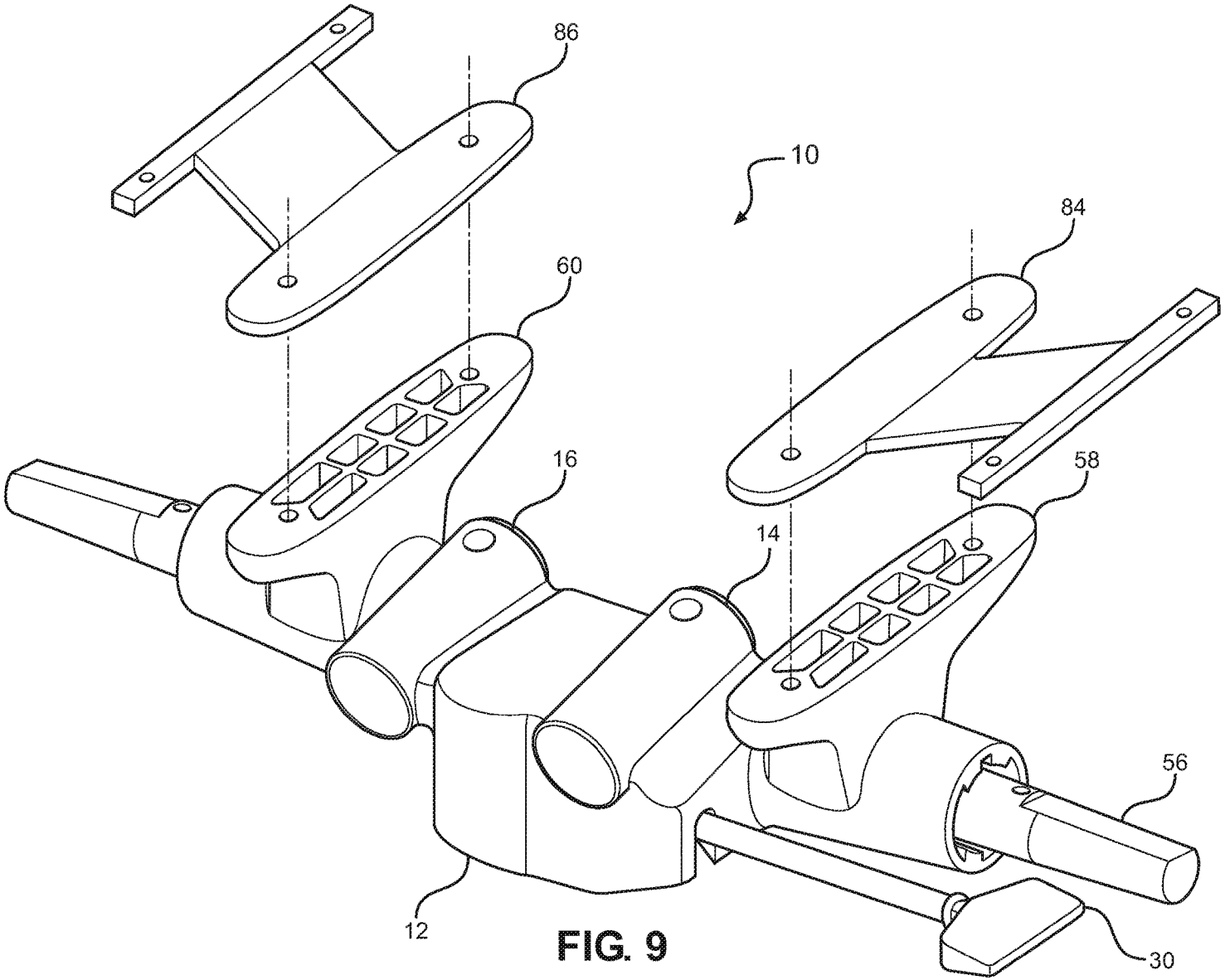
FIG. 9 is a perspective view of a further alternative pivoting mechanism according to the invention.
Figure 10:
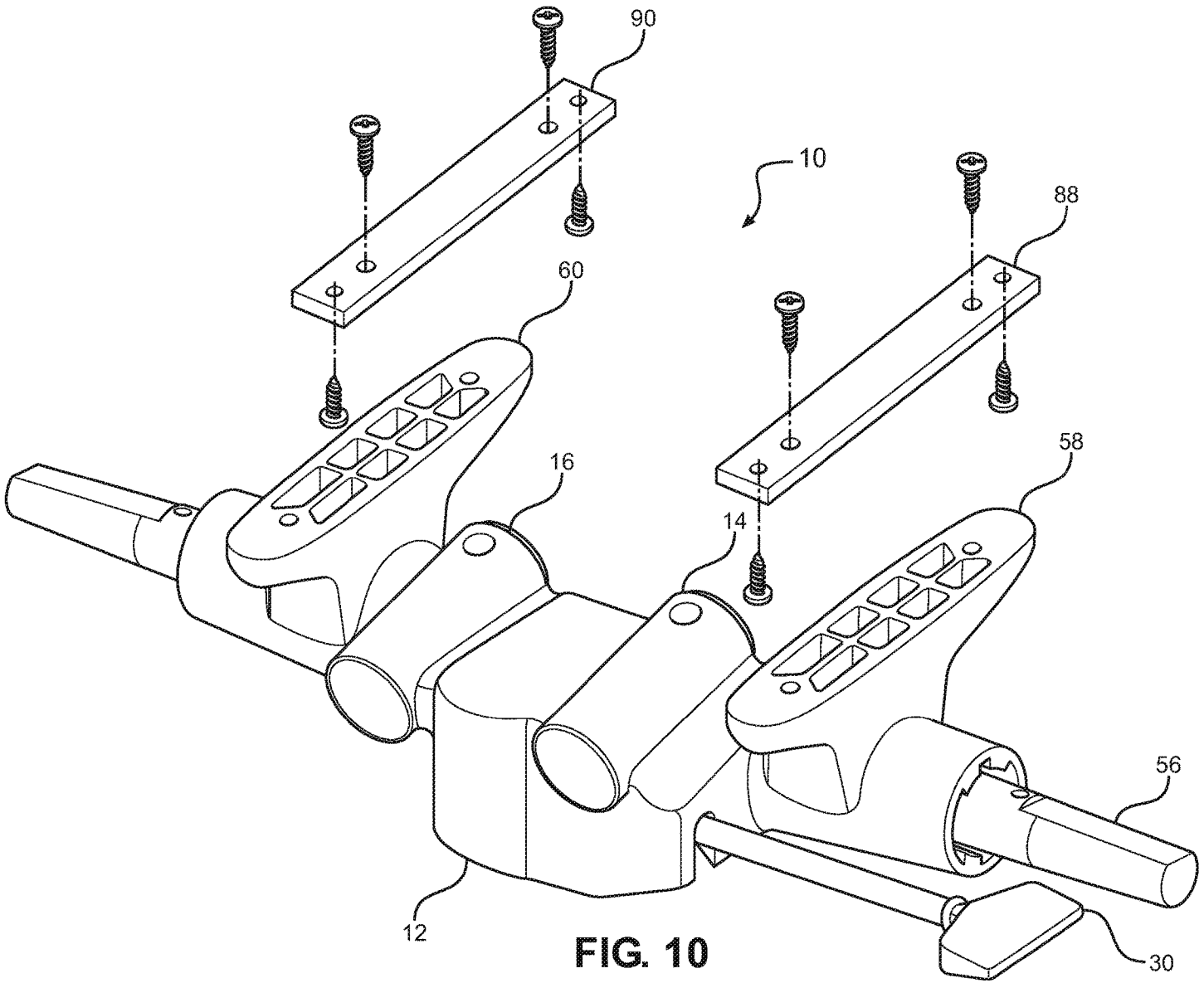
FIG. 10 is a perspective view of another pivoting mechanism according to the invention.

As is shown, for instance, in FIG. 9, the mounts 58 and 60 can be employed to retain brackets 84 and 86, which in turn could be exploited to retain a seat bottom with a framework, such as a framework supporting a panel of elastomeric mesh or other material. As shown in FIG. 10, the mounts 58 and 60 could also be employed to retain mounting plates 88 and 90 thereby also to facilitate retaining chair components, such as a padded seat bottom.

Figure 11:
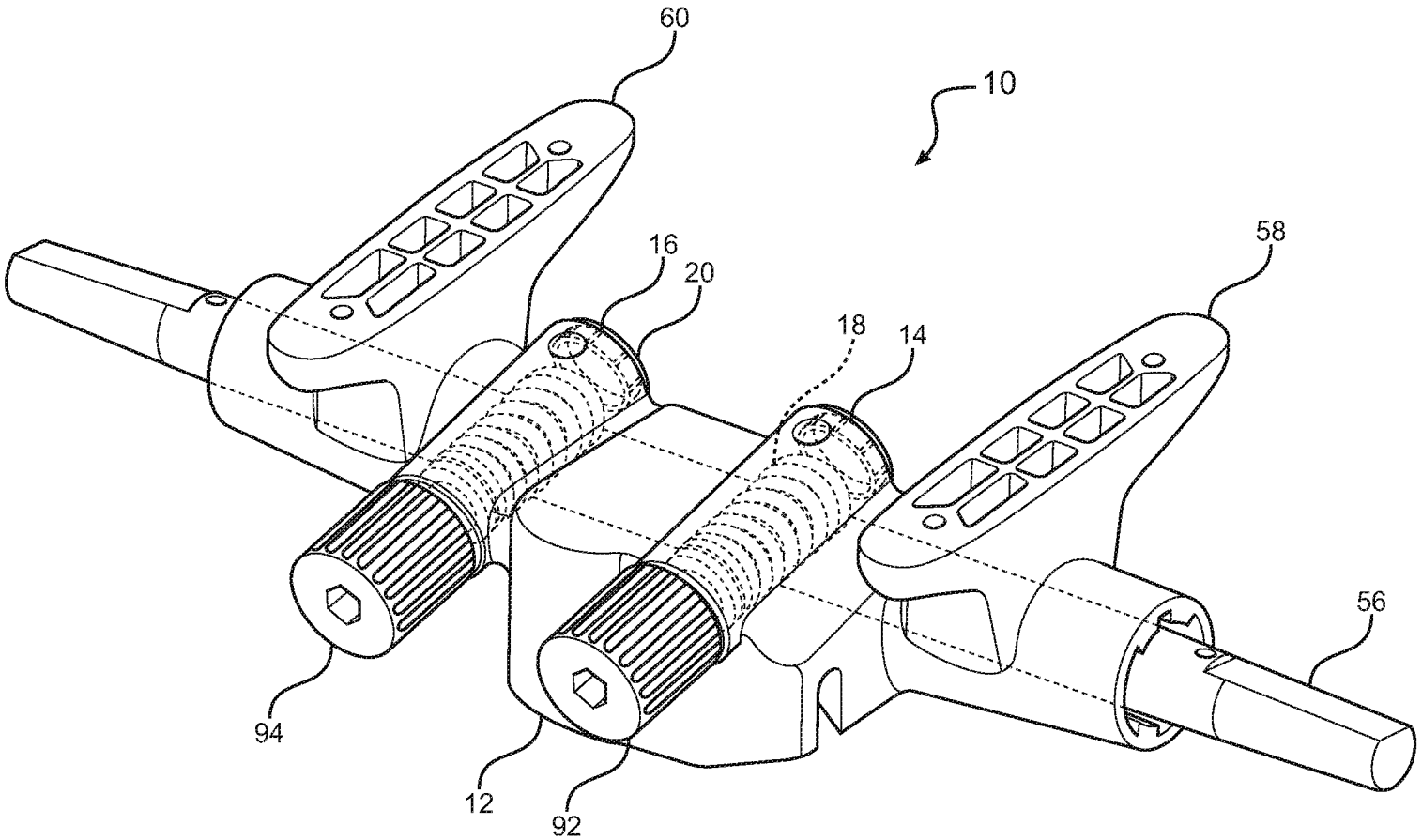
FIG. 11 is a partially-sectioned perspective view of an additional pivoting mechanism according to the invention.
Figure 12:
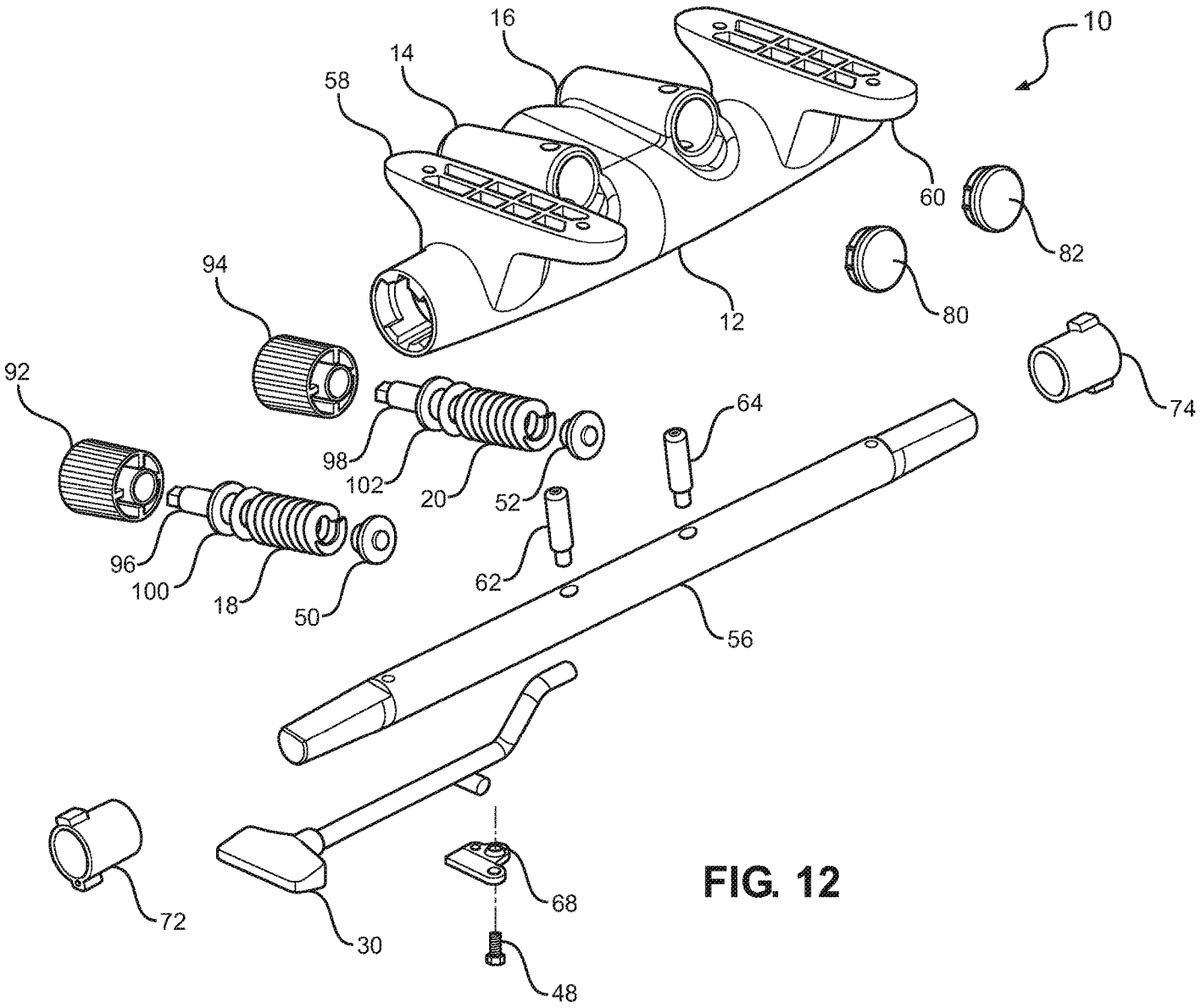
FIG. 12 is an exploded perspective view of the pivoting mechanism of FIG. 11.
Figure 13:
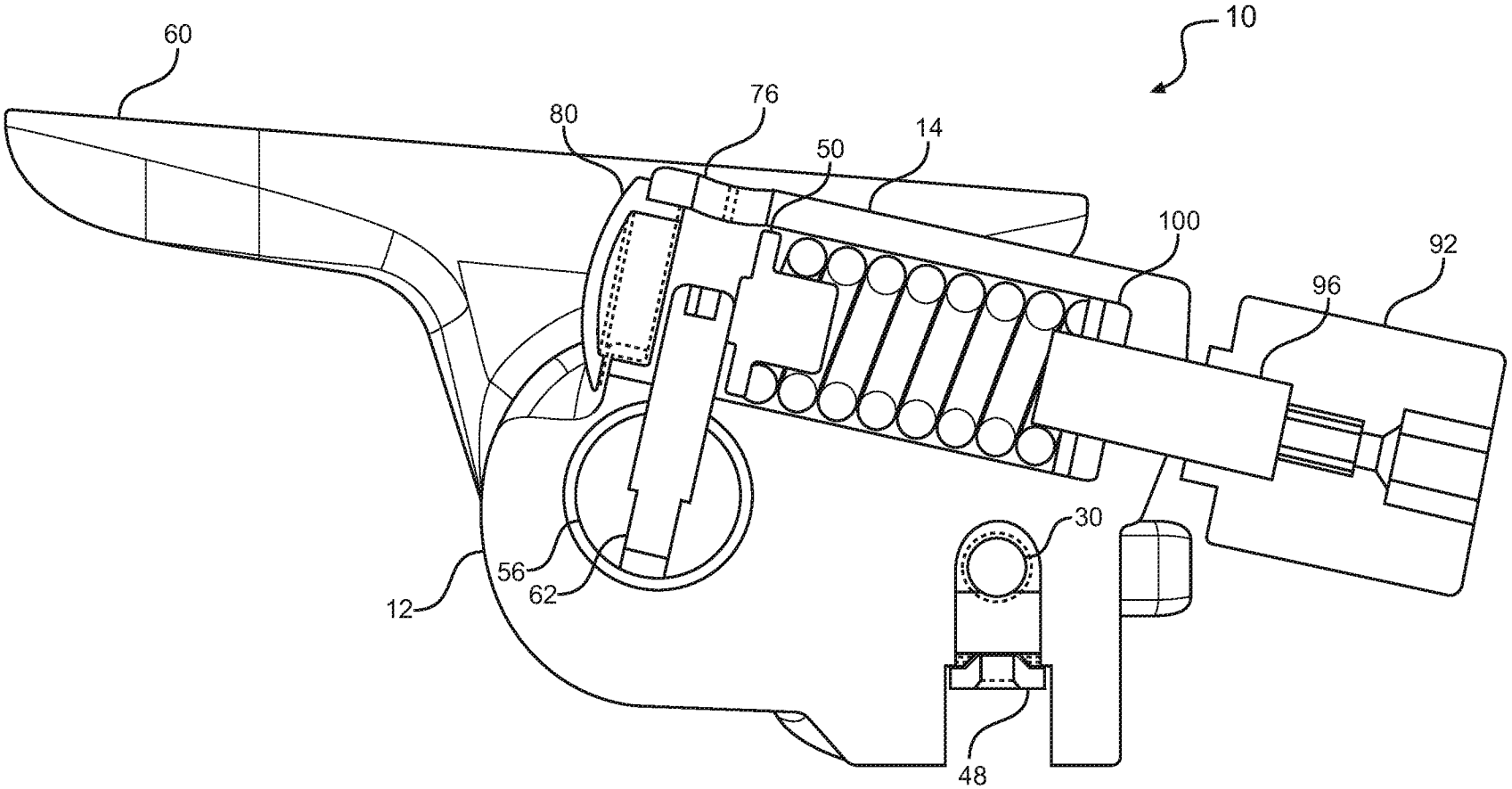
FIG. 13 is a cross sectional view of the pivoting mechanism of FIG. 11 in a non-pivoted configuration.

Looking to FIGS. 11 through 13, one can perceive that embodiments of the pivoting mechanism 10 are contemplated wherein the initial compression of the springs 18 and 20 is adjustable thereby to adjust the pivoting resistance provided by the pivoting mechanism 10. There, the pivoting mechanism 10 is substantially as shown and described above except that drive members 96 and 98, which can be threaded or otherwise selectively advanced and retracted, are engaged with proximal ends of the springs 18 and 20. Here, the drive members 96 and 98 are threaded and are actuated by rotation. The drive members 96 and 98 could be rotated, for instance, by operation of adjustment handles 92 and 94 or by some other mechanism, such as a wrench. Roller bearing washers 100 and 102 can be interposed between the proximal ends of the springs 18 and 20 and the drive members 96 and 98 to permit rotation of the adjustment knobs 92 and 94 even where large spring forces are present. The adjustment knobs 92 and 94 can have openings for a wrench driver, such as an Allen wrench. Under this construction, the springs 18 and 20 can be adjusted in pre-compression condition thereby to adjust the resistance provided to rotation of the shaft 56.

Figure 14:
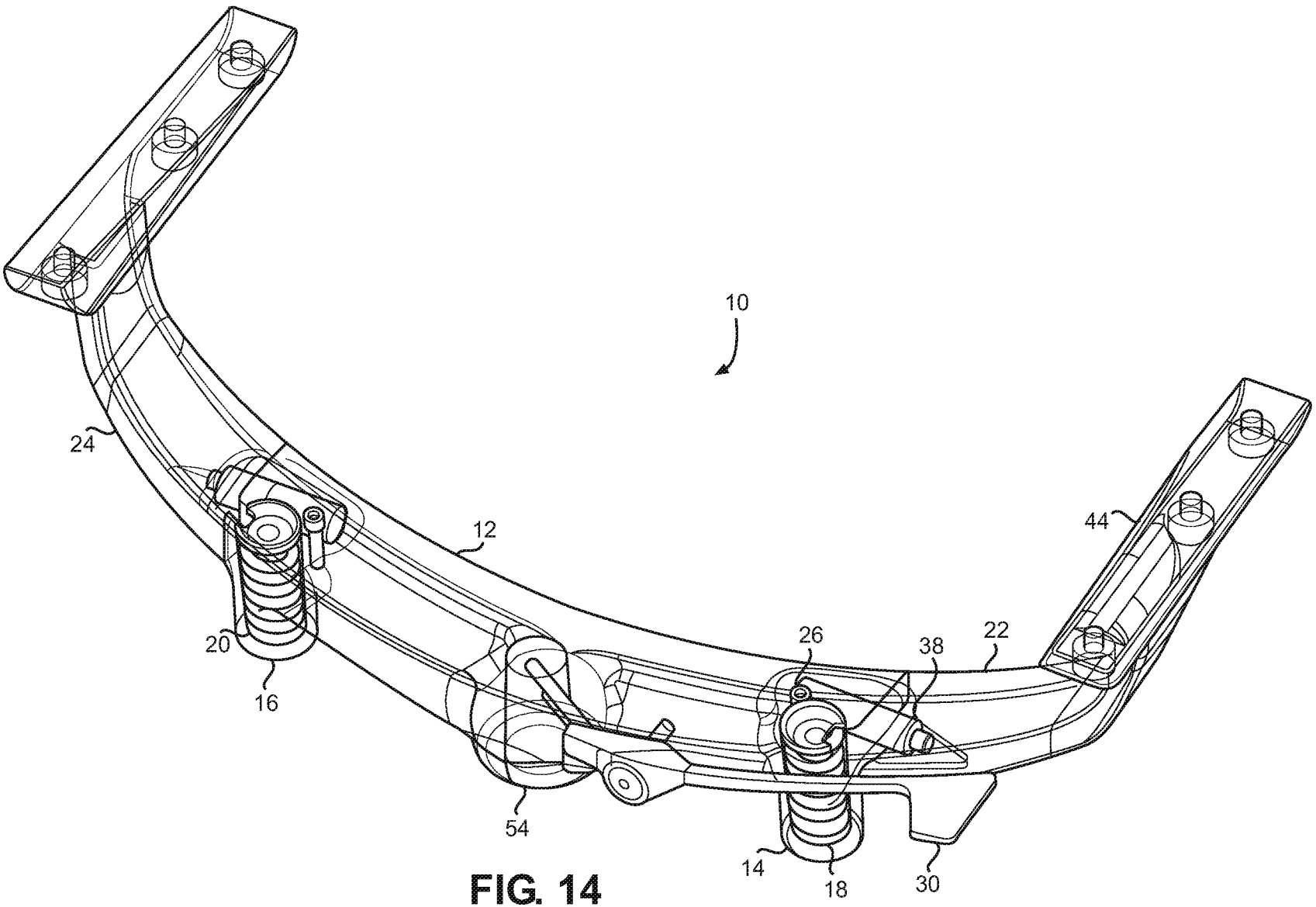
FIG. 14 is a partially-sectioned perspective view of an additional pivoting mechanism according to the invention.
Figure 15:
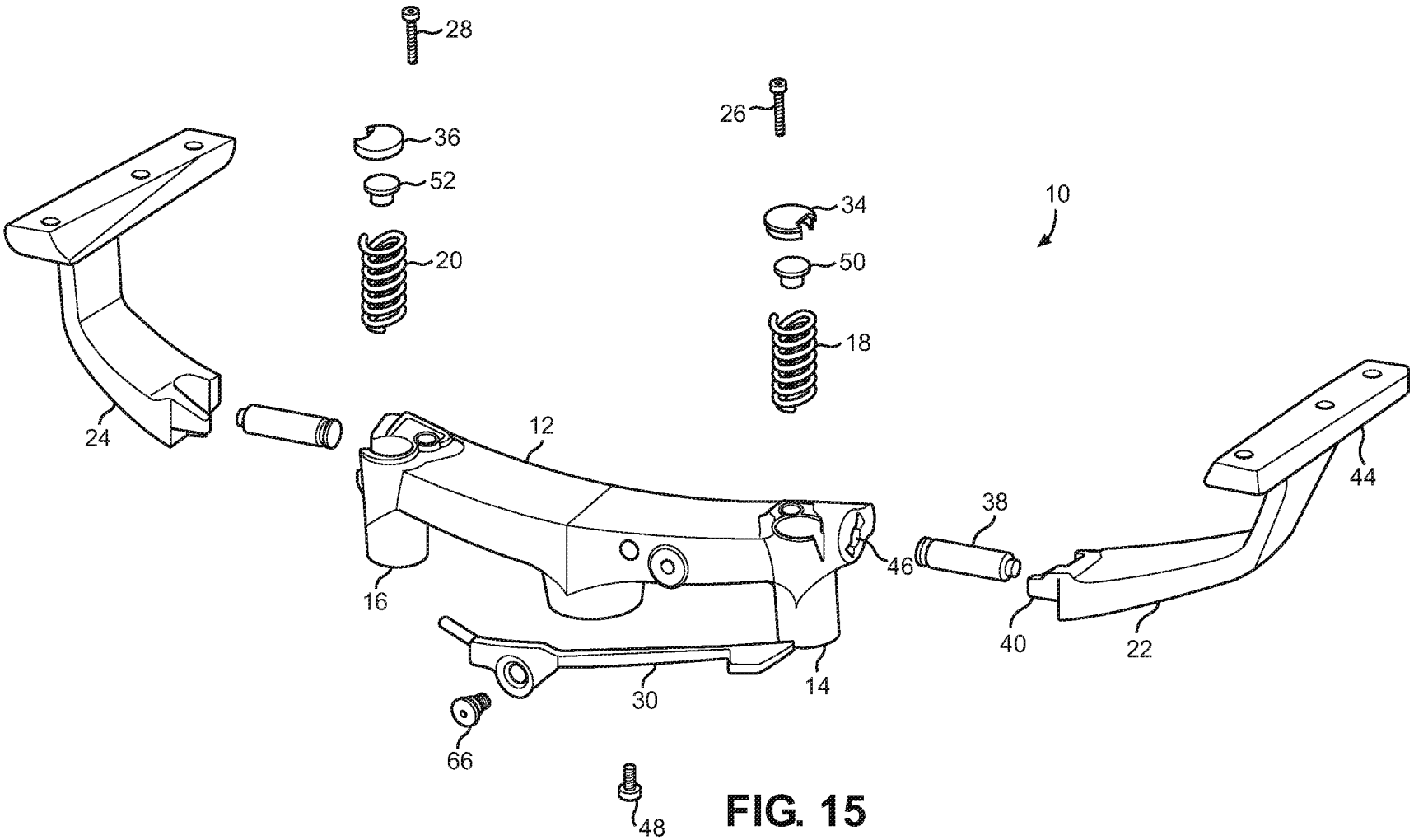
FIG. 15 is an exploded perspective view of the pivoting mechanism of FIG. 14.

A further pivoting mechanism 10 is illustrated in FIGS. 14 and 15. There, the pivoting mechanism 10 is again founded on a mechanism body 12 that has first and second arms the project from a central hub 54. A first spring housing 14 is disposed at a distal end of the first arm, and a second spring housing 16 is disposed at a distal end of the second arm. A first compression spring 18 is received in the first spring housing 14, and a second compression spring 20 is received in the second spring housing 16.

A pivot receiver aperture 46 is also disposed in the distal end of each arm. The centers of the receiver apertures 46 are spaced a given distance from the centers of the spring housings 14 and 16. The spring housings 14 and 16 again have longitudinal axes disposed generally vertically, and the pivot receiver apertures 46 have axes that project generally laterally such that the axes of the spring housings 14 and 16 and the pivot receiver apertures 46 are generally orthogonal.

A right support 22 is pivotally engaged with the pivot receiver aperture 46 disposed at the end of the first arm, and a left support 24 is pivotally engaged with the pivot receiver aperture 46 disposed at the end of the second arm. Each support 22 and 24 has a pivot hub 38, which here comprises a rod, that projects from the support 22 or 24. The pivot hubs 38 are matingly received into the pivot receiver apertures 46 whereby the supports 22 and 24 can pivot in relation to the arms of the mechanism body 12. Here, however, the spring housings 14 and 16 and the pivot receiver aperture 46 are disposed in greater proximity to the central hub 54, and the supports 22 and 24 have lateral portions and upright portions leading to distal mounts 44 that can be employed to retain a seat component, such as a seat bottom, a seat back, and/or seat arms. As such, the proximal portions of the supports 22 and 24 and the distal portions of the arm of the mechanism body 12 approximate continuous arms that are bifurcated by the pivoting connection between the supports 22 and 24 and the arms. A height adjustment lever 30 pivots about a pivot axis formed by a bolt 66, and pivoting of the lever 30 can be selectively prevented by actuation of a height stop screw 48.

As before, the supports 22 and 24 and the pivot receiver apertures 46 have pivot limiting formations that permit pivoting of the supports 22 and 24 relative to the mechanism body 12 over a give range of angular pivoting. Formations on the supports 22 and 24 concentric with the pivot hubs 38 engage with corresponding formations in the apertures 46 on the mechanism body 12 to form a butterfly joint, which permits pivoting of the supports 22 and 24 over a given degree of angular rotation.

Eccentric deflecting members 40 again project from the mounts 44 of the supports 22 and 24 oriented generally in alignment with the pivot hubs 38. The deflecting members 40 are disposed eccentric to the pivot hubs 38 by approximately the distance between the centers of the pivot receiver apertures 46 and the first and second spring housings 14 and 16. Each spring housing 14 and 16 has a longitudinal channel therein for receiving the deflecting members 40 to permit arcuate movement thereof during a pivoting of the supports 22 and 24. The deflecting members 40 are thus disposed to engage distal ends of the first and second springs 18 and 20 when the pivot mechanism 10 is assembled. Rigid spring pivots 50 and 52, each comprising a tubular portion received into the respective spring 18 or 20 and a cap portion disposed atop the spring 18 or 20, are interposed between the deflecting members 40 and the distal ends of the springs 18 and 20 to facilitate reliable movement of the deflecting members 40 and compression of the springs 18 and 20. Spring dust caps 34 and 36 cap the spring housings 14 and 16.

Figure 16:
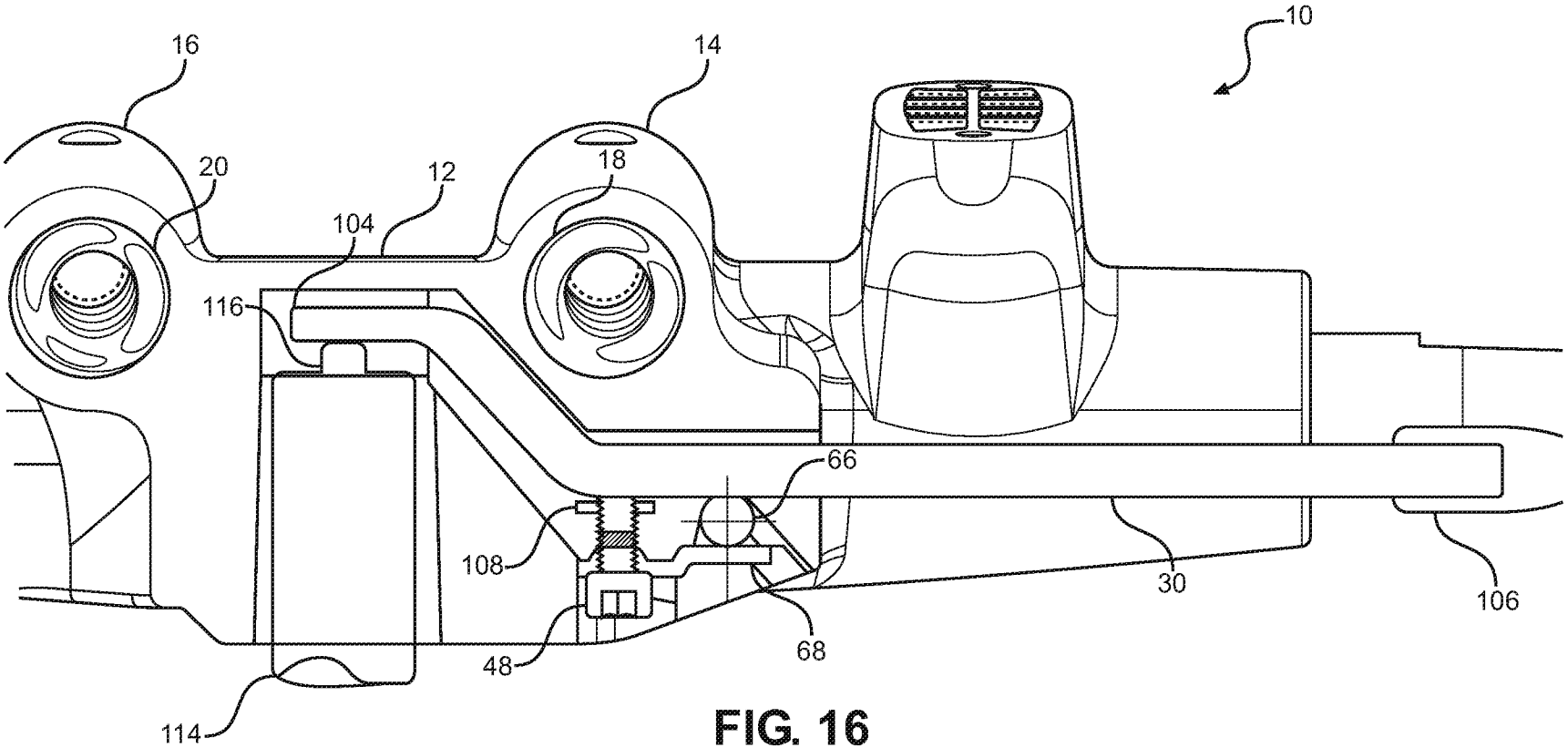
FIG. 16 is a cross sectional view of a chair height locking system as disclosed herein.

A height adjustment lever 30 is pivotally retained by the mechanism body 12. The height adjustment lever 30 has a tip thereof selectively operable to actuate a height adjustment mechanism, such as a pneumatic cylinder 114, as seen in FIG. 16, for instance. As is shown and described below, a height stop screw 48 can be selectively engaged with the height adjustment lever 30 to prevent pivoting of the height adjustment lever 30 and actuation of the height adjustment mechanism 114 thereby to fix a given chair at a selected height.

Figure 17A:
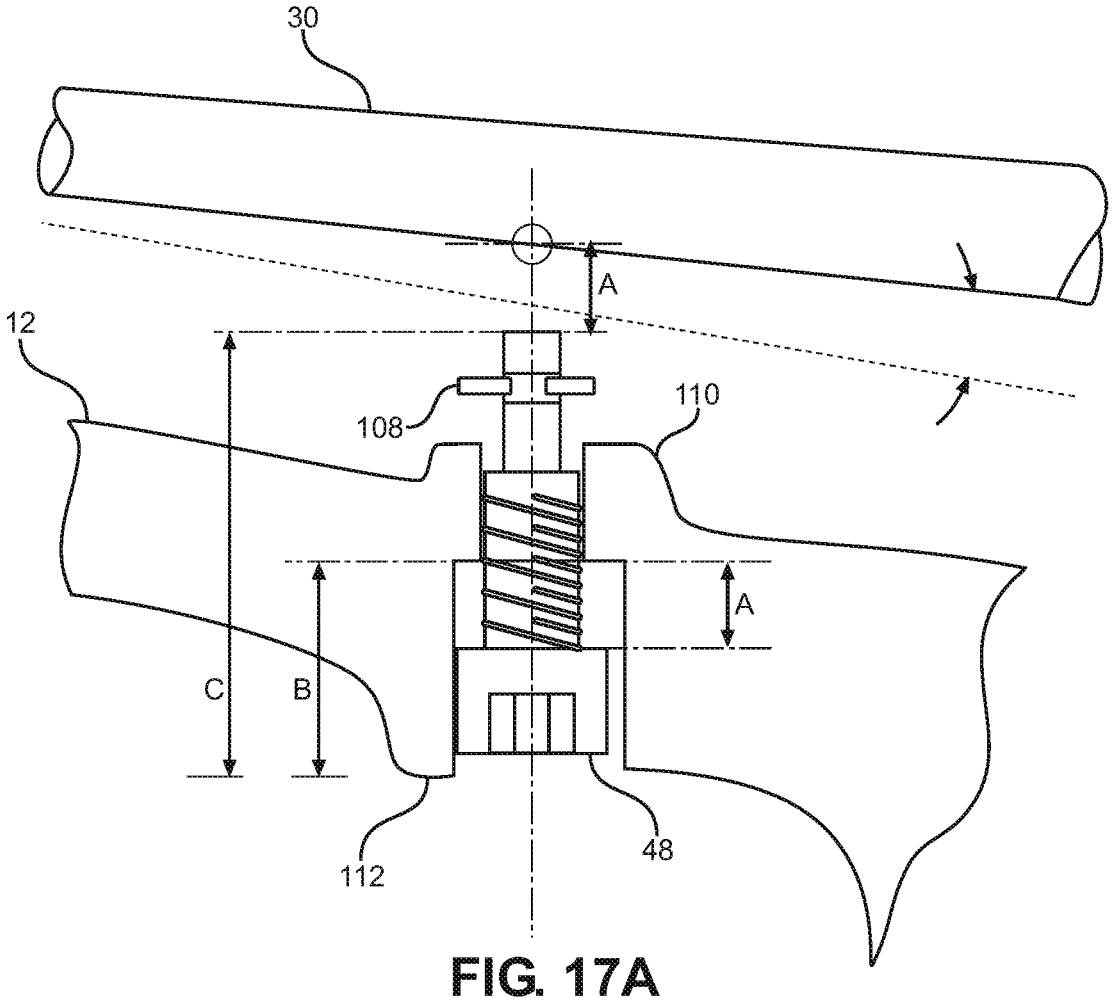
FIG. 17A is a further cross sectional view of a chair height locking system pursuant to the present invention.
Figure 17B:
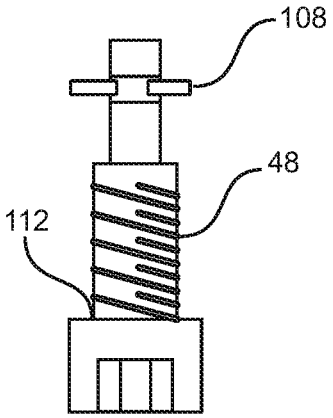
FIG. 17B is a view in front elevation of a locking screw according to the disclosed invention.

The chair height locking system can be understood with further reference to FIGS. 16, 17A, and 17B. There, the height adjustment lever 30 is shown to pivot in relation to the mechanism body 12 about a pivot axis 66, which is here formed by a rod but which could be formed in any effective manner. The height adjustment lever 30 has a handle 106 at a first end thereof for being actuated by a user and an engaging tip 104 at a second end thereof for pressing on and actuating a height adjustment mechanism, which in this case comprises a pneumatic rod 114 with an actuating tip 116. The height adjustment lever 30 has a zone of normal operation wherein, over one portion, the lever 30 is disengaged from the actuating tip 116 of the pneumatic rod 114 and wherein, over a second portion, the tip 116 of the lever 30 engages the actuating tip 116. As is known in the art, when the actuating tip 116 of the hydraulic or pneumatic rod 114 or other height adjustment mechanism is actuated, the effective length of the rod 114 can be adjusted thereby to achieve an adjustment of the height of the supported mechanism body 12 and the retained chair components, such as a seat back, seat bottom, seat arms, or any combination thereof.

A height stop screw 48 is threadedly engaged with the mechanism body 12 in alignment with a body portion of the height adjustment lever 30. Here, the height stop screw 48 is disposed to align with a portion of the height adjustment lever 30 between the pivot axis 66 and the engaging tip 104. The height stop screw 48 can be selectively extended to a first, restraining condition where the screw 48 presses against the height adjustment lever 30 and thereby limit the zone of operation to prevent the lever 30 from actuating the actuating tip 116 of the pneumatic rod 114. The height stop screw 48 can be selectively retraced to a second, non-restraining condition to free the lever 30 to pivot into actuating contact with the actuating tip 116 of the pneumatic rod 114. Under this construction, therefore, a height-adjustable chair, such as that indicated at 200 in FIGS. 18 through 23 for instance, or perhaps a group of height-adjustable chairs 200 can be adjusted to a preferred height, such as to a symmetrical height or a height designed to accommodate particular surroundings. Then, the chair 200 can be fixed against height adjustment by an extension of the height stop screw 48 into the first, restraining condition in restraining engagement with the height adjustment lever 30.

The height stop screw 48 can be retained in place by a threaded engagement with the mechanism body 12, or it could be retained by a retaining plate 68 that could itself be secured in place relative to the mechanism body 12 in any appropriate manner, including mechanical fasteners 70 as is illustrated in FIG. 7A, for instance. As used in relation to the screw 48, the retaining plate 68 and the mechanism body 12 will be referred to as a retaining member.

As shown in FIGS. 17A and 17B, the height stop screw 48 can have a protuberance, which in this embodiment comprises a safety washer 108, disposed along a body portion thereof distal to the retaining plate 68 or the mechanism body 12 relative to the head of the screw 48 thereby to prevent the screw 48 from being unintentionally disengaged. The screw 48 can have an overall length C. The screw 48 can have a shoulder 112, and the retaining member can have a shoulder 110. There can be considered to be a distance B comprising the distance from the shoulder 110 to the surface of the retaining member. Moreover, when the screw 48 is retracted, there is a distance A between the shoulders 110 and 112 that is also the distance between the second, non-restraining condition permitting actuating movement of the lever 30 and the first, restraining condition preventing actuating movement of the lever 30. The distance A can be sufficient to prevent operation of the lever 30 but not so great as to apply excessive force to the lever 30 as might cause damage or displacement to the lever 30 or the pivot axis 66.

Figure 18:
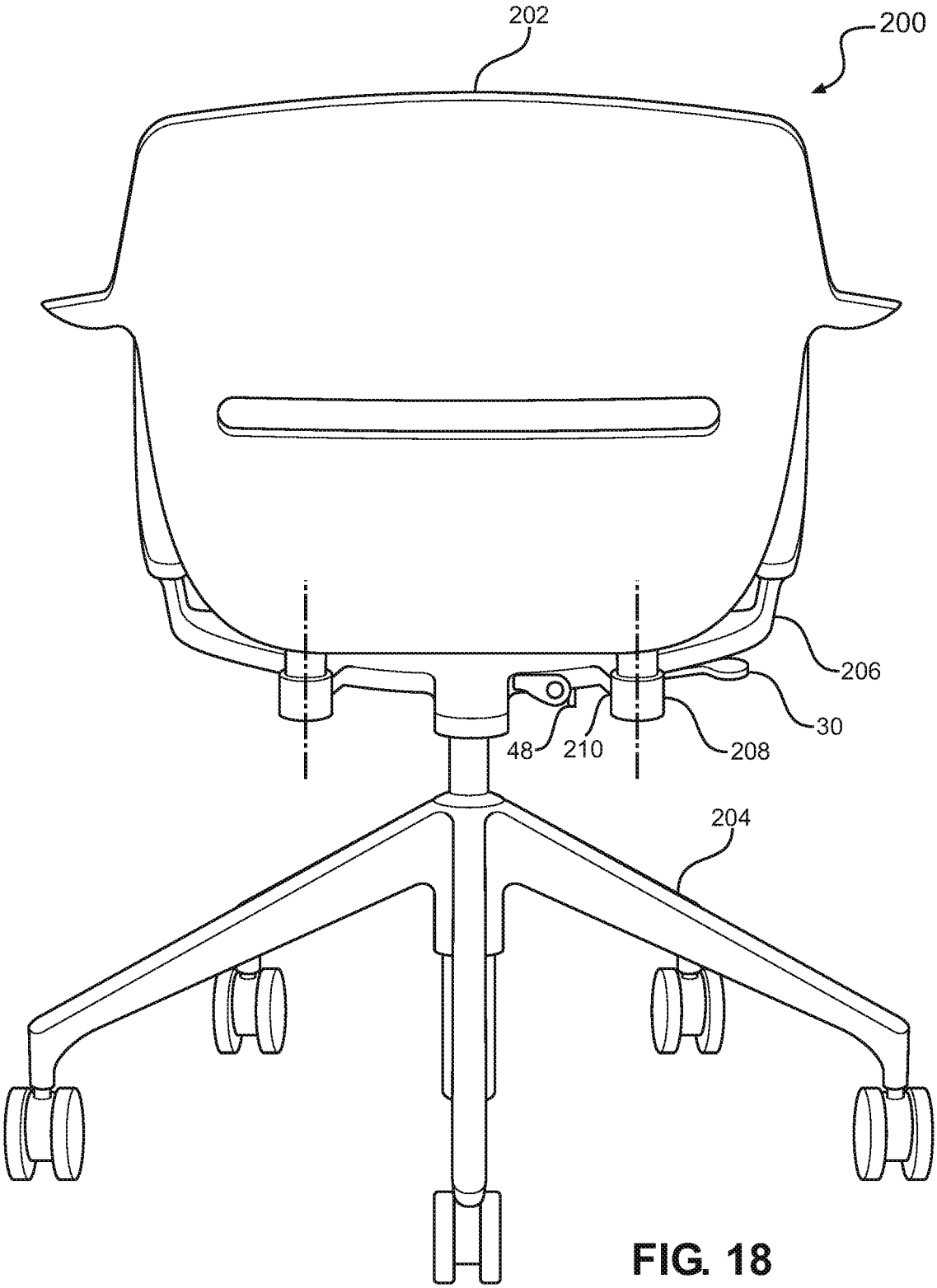
FIG. 18 is a view in rear elevation of a chair with a further pivoting mechanism.
Figure 19:
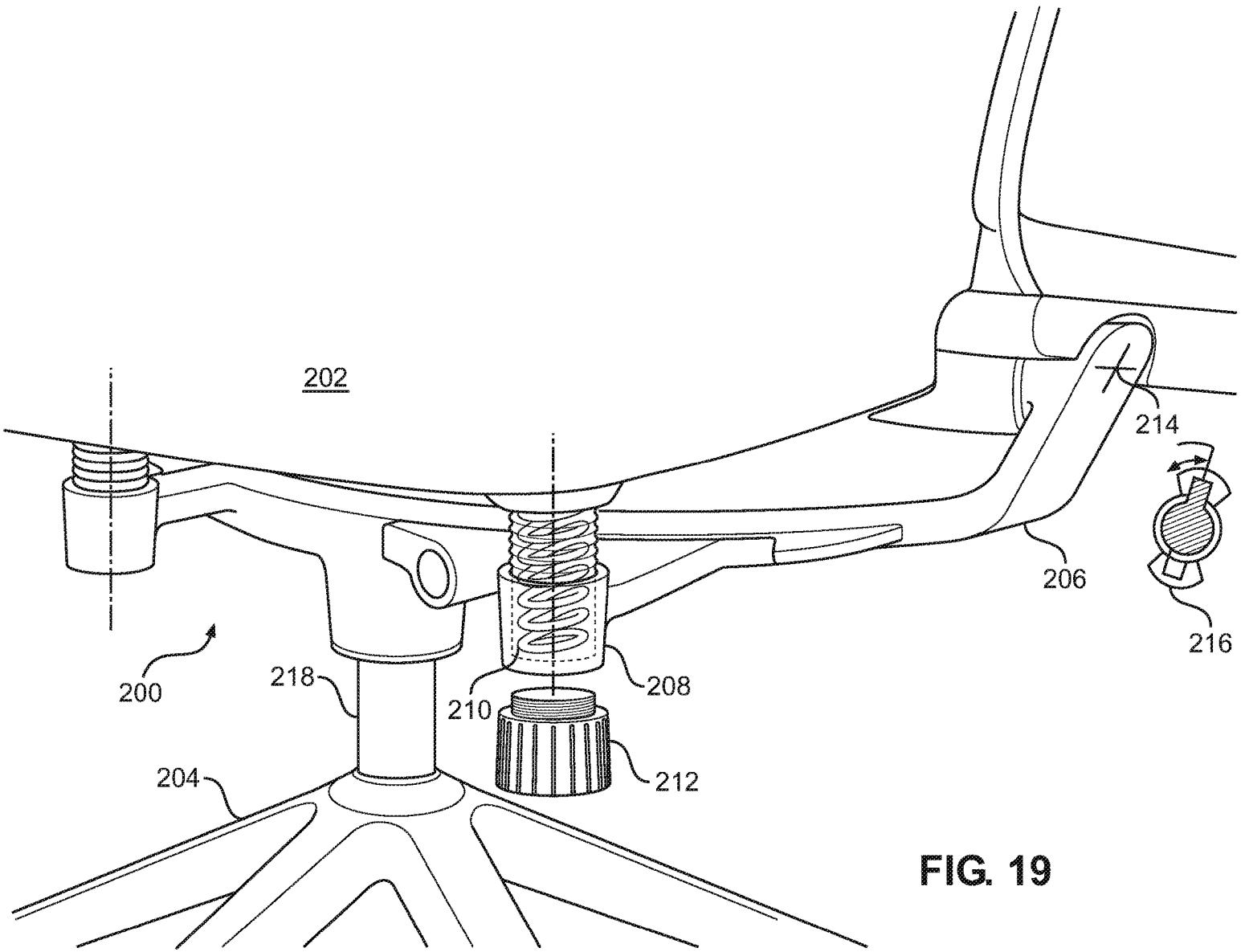
FIG. 19 is a rearward perspective view of the chair of FIG. 18.

A further pivot mechanism is illustrated in relation to a chair 200 in FIGS. 18 and 19. There, the chair 200 has a chair shell 202 supported by a chair base 204 through a support rod 218. The chair shell 202 is pivotable about a pivot axis 214 with a butterfly joint 216 and is supported by a bracket 206. Spaced from the pivot axis 2014, the chair 200 has first and second spring housings 208 retained by the bracket 206, and compression springs 210 are interposed between the spring housings 208 and the chair shell 202 thereby to provide resilient, pivoting support to the chair shell 202. In certain embodiments, by operation of, for example, control knobs 212, the initial compression of the springs 210 can be adjusted.

Figure 20:
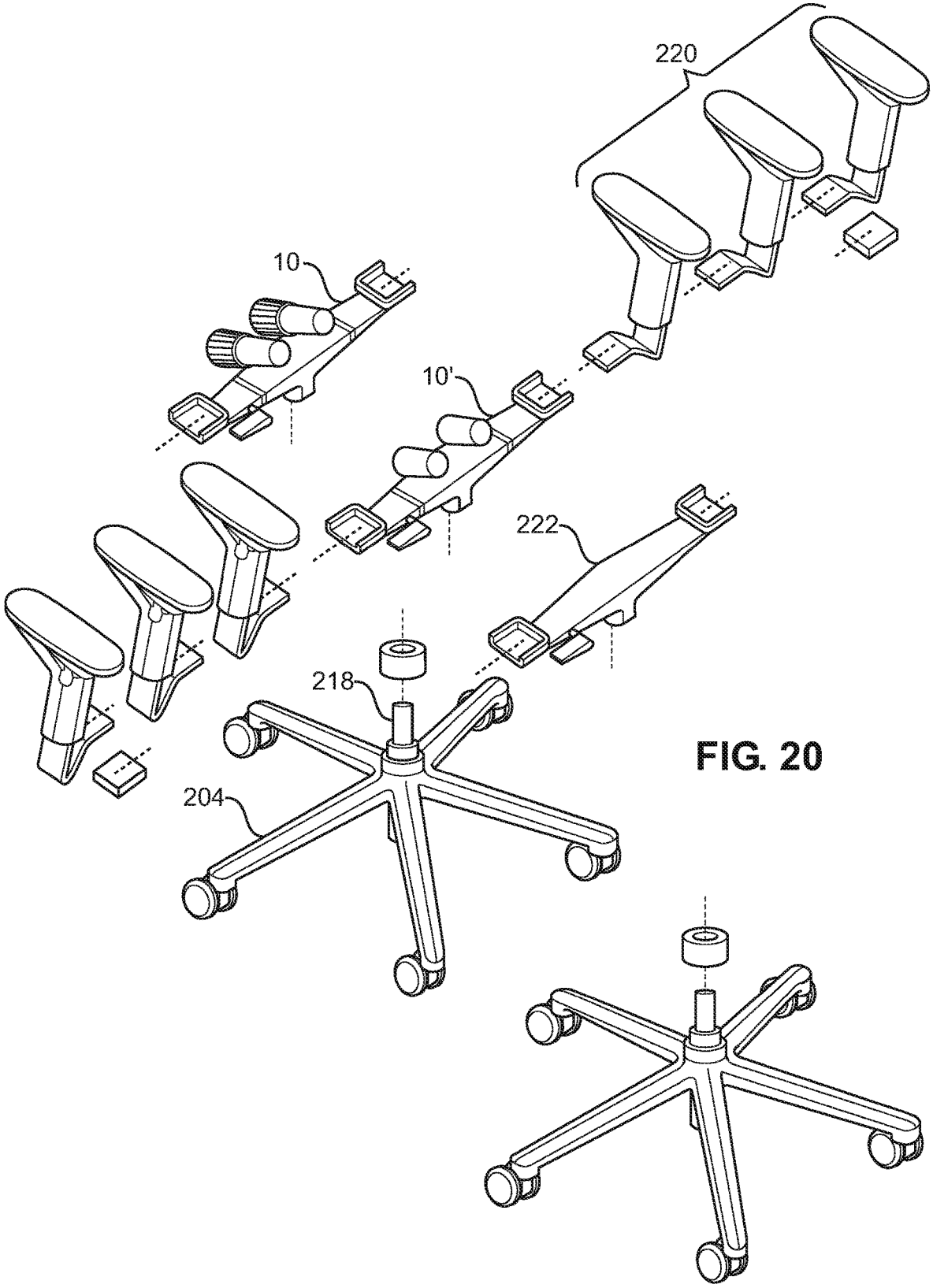
FIG. 20 is an exploded perspective view of alternative chair features.
Figure 21:
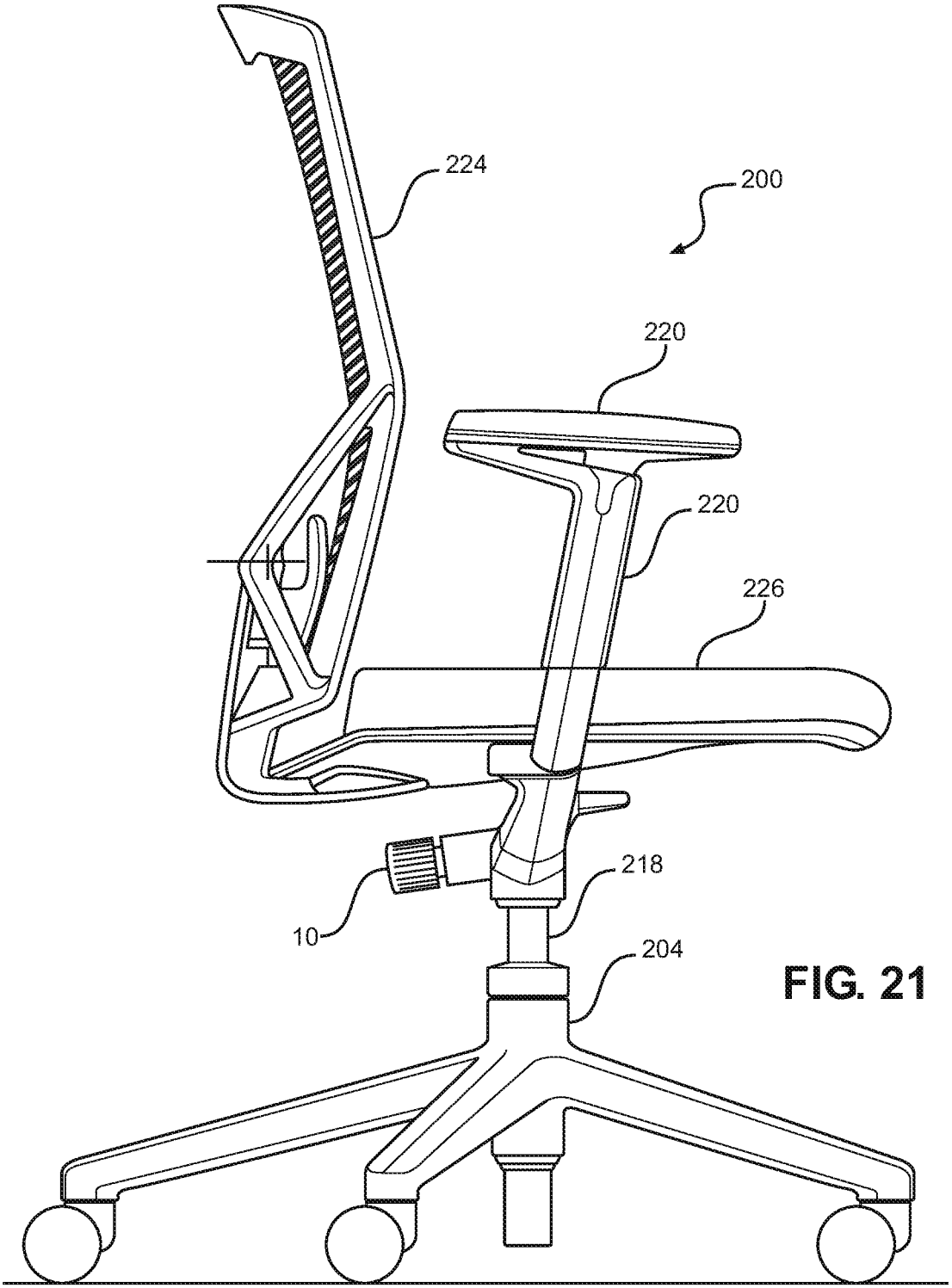
FIG. 21 is a view in side elevation of a chair incorporating a pivoting mechanism as taught herein.
Figure 22:
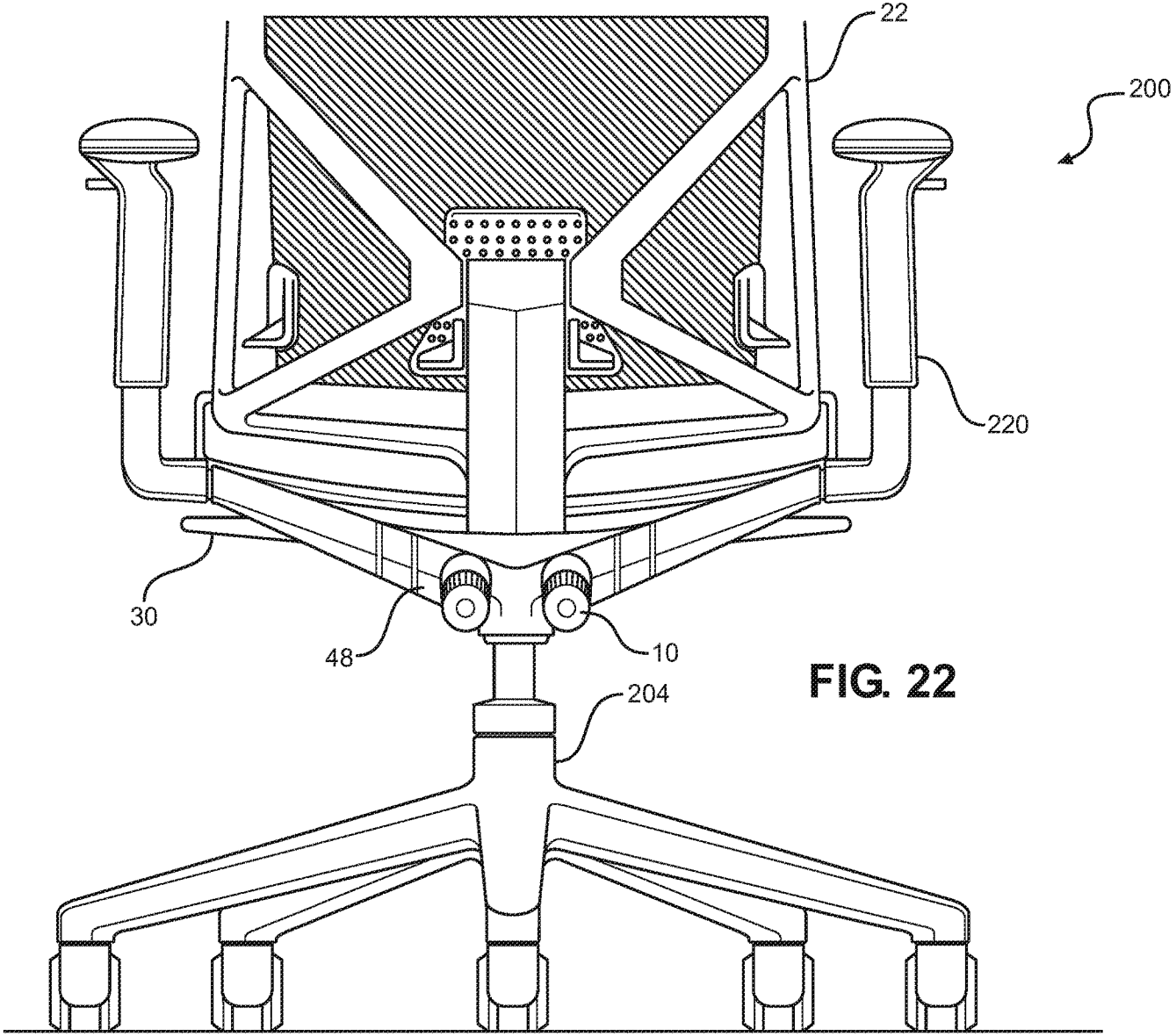
FIG. 22 is a view in rear elevation of the chair of FIG. 21.
Figure 23:
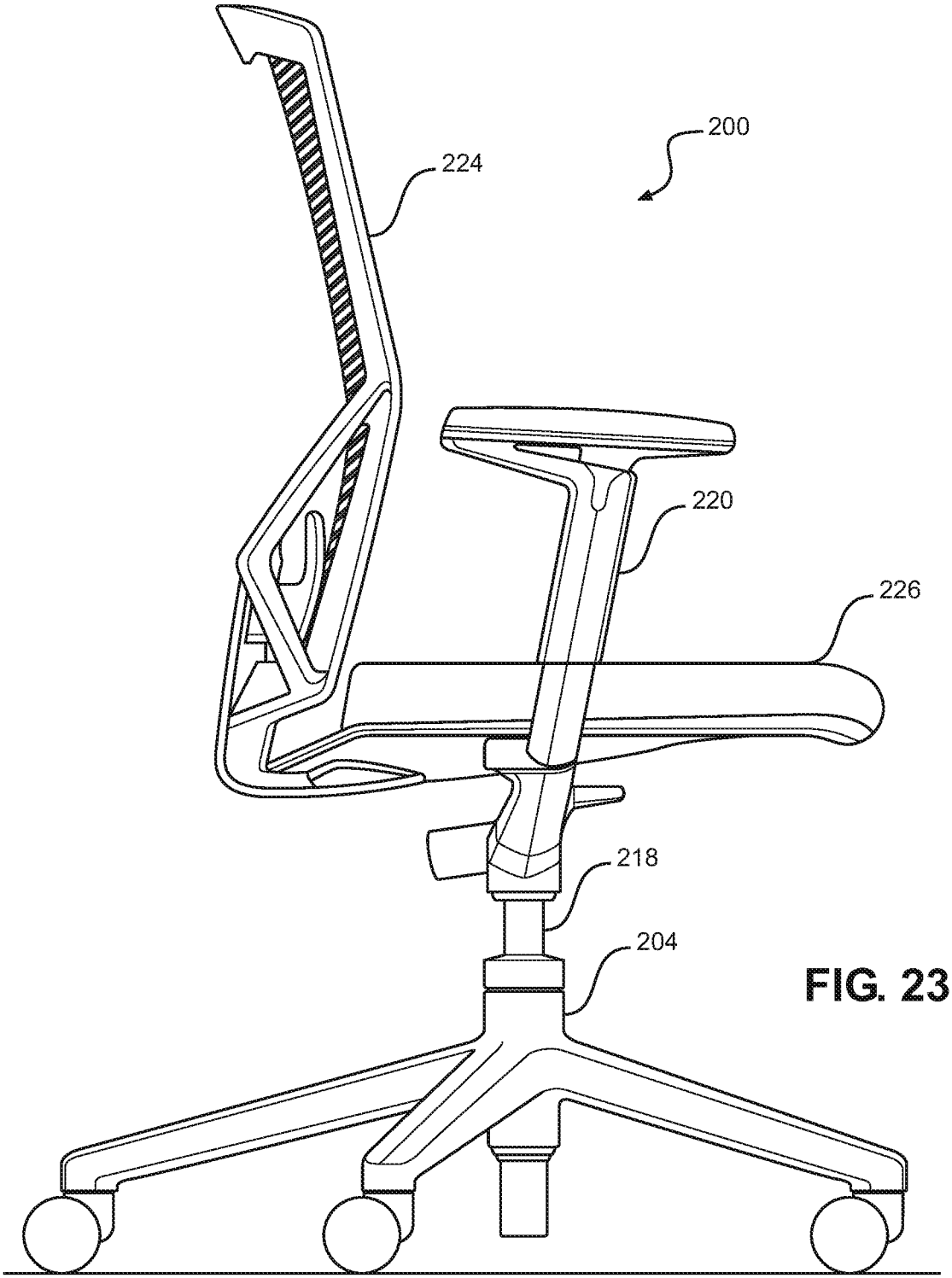
FIG. 23 is a view in side elevation of a chair incorporating an alternative pivoting mechanism according to the invention.
Figure 24A:
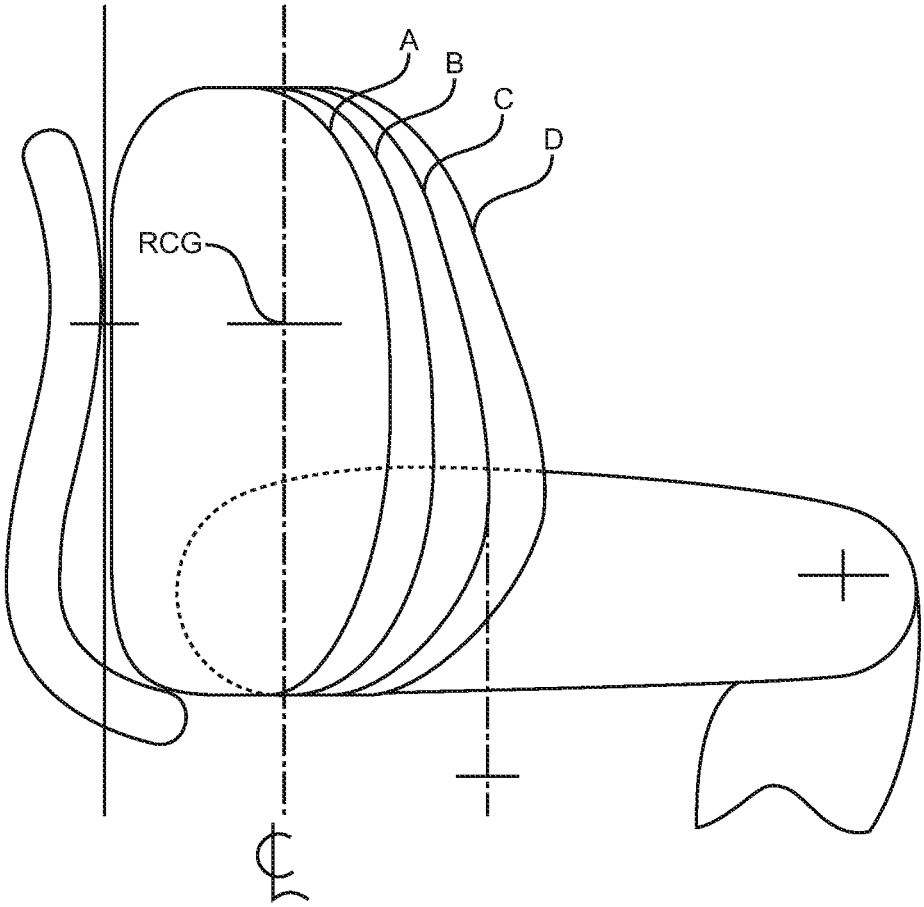
FIG. 24A is a schematic view in side elevation depicting relative centers of gravity of various human bodies in relation to a pivot axis.
Figure 24B:
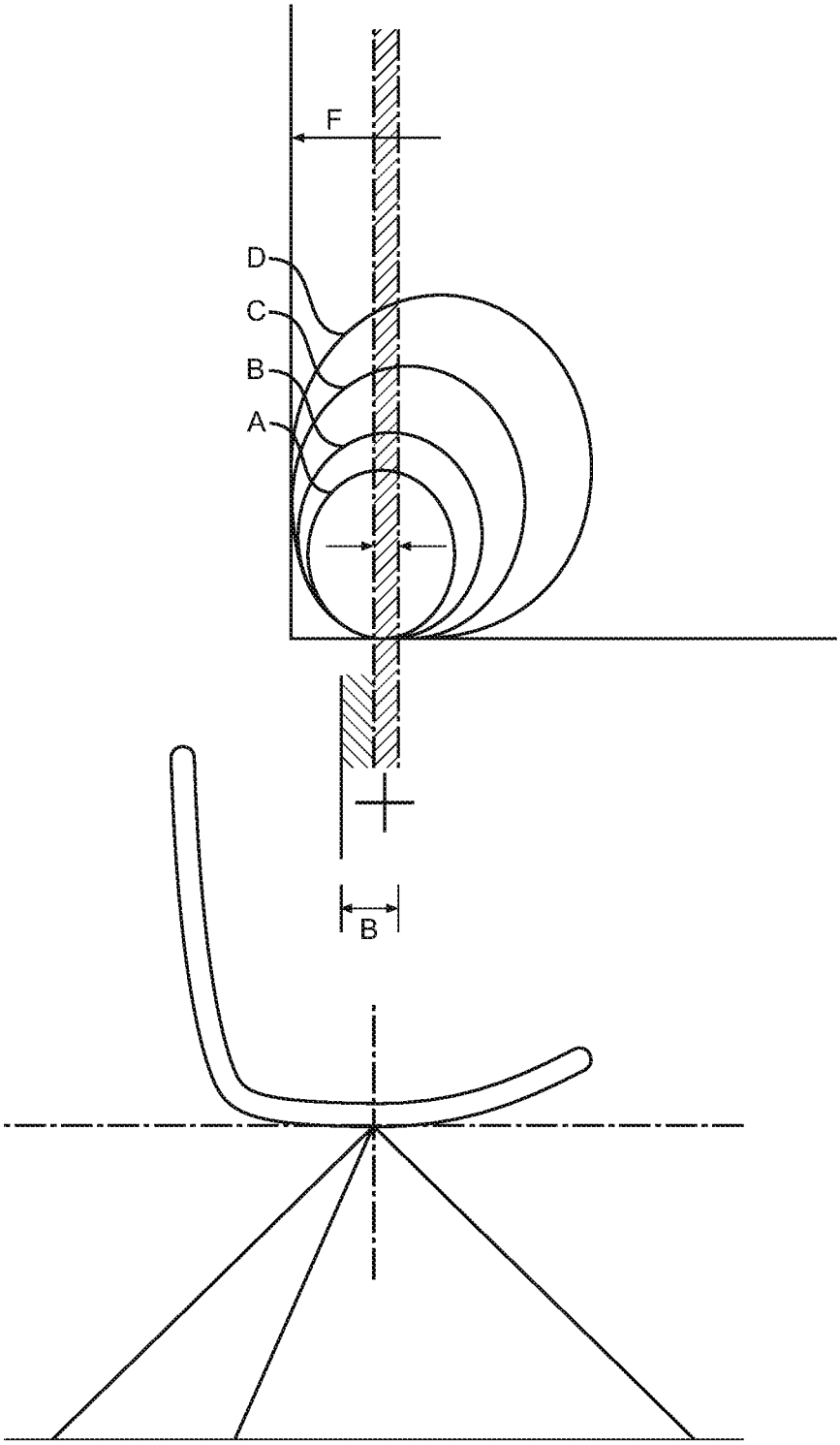
FIG. 24B is a further schematic view in side elevation depicting relative centers of gravity of various human bodies in relation to a pivot axis.
Figure 25:
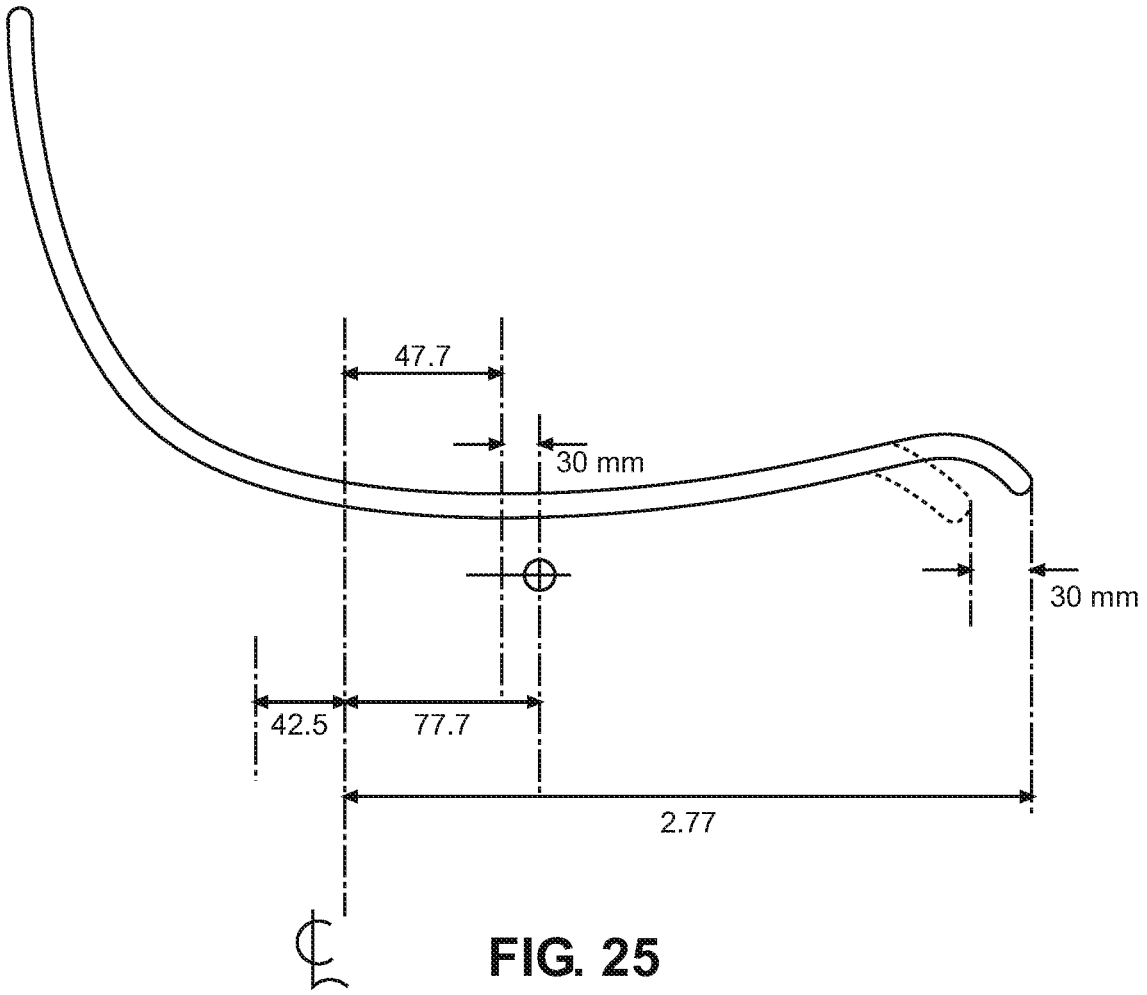
FIG. 25 is a view in side elevation depicted a preferred pivot axis location.
Figure 26:
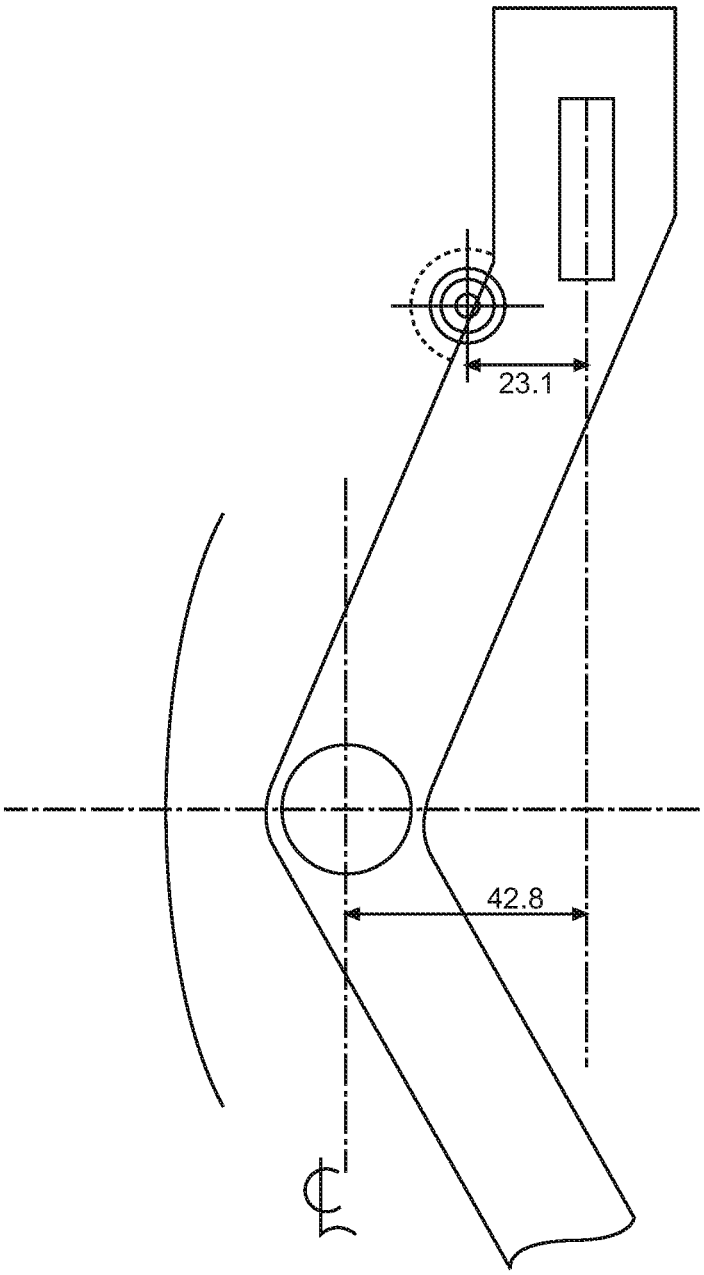
FIG. 26 is a schematic top plan view of a pivoting mechanism as disclosed herein with a preferred pivot axis in view of projected seat occupant relative centers of gravity.
Figure 27:
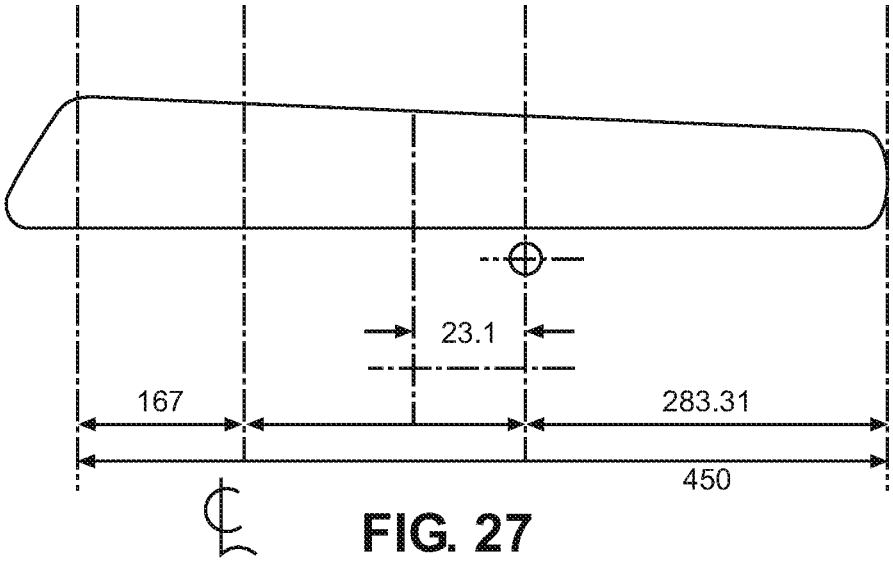
FIG. 27 is a schematic view in side elevation of a preferred pivot axis in relation to a projected seat occupant relative center of gravity.
Figure 28:
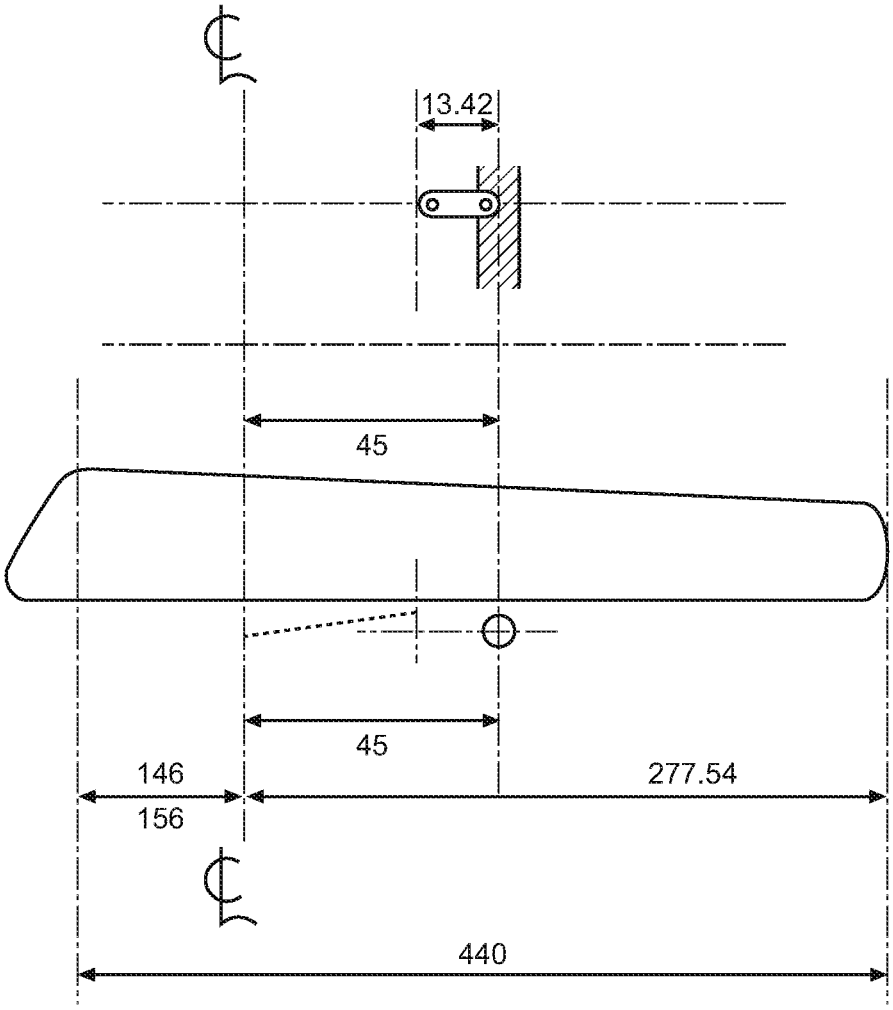
FIG. 28 is another schematic view in side elevation of a preferred pivot axis in relation to a projected seat occupant relative center of gravity.

The adaptability of the invention can be further understood with reference to FIGS. 20 through 23 wherein alternative options are illustrated. As shown in FIG. 20, for instance, fixed, pivoting support mechanisms 10' as also shown in FIG. 21, and adjustable resistance support mechanisms 10 as also shown in FIGS. 22 and 23 can be selectively employed. Moreover, varied arm constructions 220 can be selectively attached. Still further, different support bases 204 can be readily employed.

The pivoting mechanisms 10 disclosed herein permit a pivot axis to be established within what has been determined to be a preferred zone of pivot axes as is illustrated, for instance, in FIGS. 24A through 28. The disclosed pivoting mechanisms 10 provide extremely compact configurations while permitting pivoting over a desired angular range. The location of the pivot point is rendered close to the human body's center of gravity to limit the need for large spring displacement. Moreover, through use of the pivoting mechanism 10, the chairs 200 do not need excessive force of rotation to induce pivoting of, for instance, supports 22 and 24 and a seat retained thereby. In that regard, it will be noted, as illustrated, that the relative centers of gravity of persons even of very different body sizes and types as illustrated at A, B, C, and D in the drawings will tend to have relatively consistent locations of relative center of gravity in relation to a seat structure. Appreciating this, the present inventor has determined that locating the pivot axis displaced from the relative center of gravity of expected seat occupants is optimal in producing pivoting over a sufficient range in an efficient pivoting mechanism 10. However, springs used herein must have sufficient strength to provide resilient resistance, such as in the range of 1300-1500 lb/in. The pivoting mechanism creates zones where very little countervailing force is required. At present, 10.5 to 11.5 degrees of pivoting is preferred with 11 degrees being ideal.

With certain details and embodiments of the pivoting mechanisms 10 and resulting chairs 200 of the present invention disclosed, it will be appreciated by one skilled in the art that changes and additions could be made thereto without deviating from the spirit or scope of the invention.

This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that one or more of the following claims could express certain elements as means for performing a specific function, at times without the recital of structure or material. As the law demands, any such claims shall be construed to cover not only the corresponding structure and material expressly described in this specification but also all equivalents thereof that might be now known or hereafter discovered.

I claim as deserving the protection of Letters Patent:

1. A chair comprising a chair bottom, a chair back, a chair base, a pivoting mechanism that supports the chair bottom and the chair back to pivot in relation to the chair base, a height adjustment mechanism for selectively permitting an adjustment of a height of the chair bottom and the chair back in relation to the chair base, and a height locking mechanism with a first, restraining condition wherein actuation of the height adjustment mechanism is prevented and a second, non-restraining condition wherein actuation of the height adjustment mechanism is permitted;

wherein the pivoting mechanism comprises a mechanism body with at least a first support structure pivotally engaged with the mechanism body to pivot about a pivot axis; at least a first pivoting resistance mechanism for providing resistance to a pivoting of the first support structure relative to the mechanism body wherein the height adjustment mechanism comprises an extendable and retractable cylinder with an actuating tip and a pivotable lever with a first end comprising a handle, a second end comprising a tip, and a pivot axis between the first and second ends, wherein the lever has a zone of operation wherein, over one portion of the zone of operation, the tip of the lever is disengaged from the actuating tip of the cylinder and wherein, over a second portion of the zone of operation, the tip of the lever actuates the actuating tip of the cylinder to permit adjustment of the height of the chair bottom and the chair back in relation to the chair base;

wherein the height locking mechanism, when in the first, restraining condition, limits the zone of operation of the lever to prevent the lever from pivoting into actuating engagement with the actuating tip of the cylinder and wherein the height locking mechanism, when in the second, non-restraining condition, permits the lever to pivot to actuate the actuating tip of the cylinder; and wherein the height locking mechanism comprises a height locking member that can be selectively extended to the first, restraining condition where the height locking member presses against the lever spaced from the tip and the pivot axis of the lever and thereby to limit the zone of operation of the lever to prevent the lever from actuating the actuating tip of the cylinder and wherein the height locking member can be selectively retracted to a second, non-restraining condition to free the lever to pivot into actuating contact with the actuating tip of the cylinder.

2. The chair of claim 1 wherein the mechanism body has a first pivot receiver aperture and a second pivot receiver aperture, wherein the at least a first support structure comprises a right support structure pivotally engaged with the first pivot receiver aperture to pivot about a pivot axis and a left support structure pivotally engaged with the second pivot receiver aperture to pivot about a pivot axis, wherein a first pivot hub projects from the left support structure to be pivotally received by the first pivot receiver aperture and a second pivot hub projects from the right support structure to be pivotally received by the second pivot receiver aperture, wherein the at least a first pivoting resistance mechanism comprises a first pivoting mechanism for providing resistance to a pivoting of the right support structure relative to the mechanism body and a second pivoting resistance mechanism for providing resistance to a pivoting of the left support structure relative to the mechanism body, wherein the first pivoting resistance mechanism comprises a first spring housing disposed in the mechanism body spaced from the pivot axis of the right support structure, a first spring disposed in the first spring housing, and a first pivot pin fixed to project from the right support structure spaced from the pivot axis of the right support structure to engage the first spring disposed in the first spring housing, wherein the second pivoting resistance mechanism comprises a second spring housing disposed in the mechanism body spaced from the pivot axis of the left support structure, a second spring disposed in the second spring housing, and a second pivot pin fixed to project from the left support structure spaced from the pivot axis of the left support structure to engage the second spring disposed in the second spring housing, and wherein the first and second springs are compression springs.

3. The chair of claim 2 wherein each of the first and second spring housings has a longitudinal that is generally orthogonal to a respective one of the pivot axes of the right and left support structures.

4. The chair of claim 2 wherein the mechanism body has a central hub and first and second arms that project from the central hub, wherein the right support structure is pivotally engaged with the first arm, and wherein the left support structure is pivotally engaged with the second arm.

5. The chair of claim 2 further comprising a longitudinal channel in each of the first and second spring housings for receiving and permitting a movement of the first and second pivot pins, respectively, wherein the pivot pins are received to pivot within the longitudinal channels.

6. The chair of claim 2 further comprising pivot limiting formations that permit pivoting of the left and right support structures over a range of angular pivoting relative to the mechanism body.

7. The chair of claim 6 wherein the pivot limiting formations comprise formations on the left and right support structures that engage with corresponding formations on the mechanism body to form a joint.

8. The chair of claim 1 wherein the height locking member comprises a height locking screw threadedly retained by a retaining portion fixed to the mechanism body.

9. The chair of claim 8 wherein the retaining portion comprises a portion of the mechanism body.

10. The chair of claim 8 wherein the retaining portion comprises a retaining member fixed to the mechanism body.

11. The chair of claim 8 further comprising a protuberance retained by the height locking screw, the protuberance operative to prevent over-retraction of the height locking screw, wherein the protuberance is fixedly retained by the height locking screw between a tip of the height locking screw and a surface of the retaining portion fixed to the mechanism body.

12. The chair of claim 11 wherein the protuberance comprises a safety washer.

13. The chair of claim 1 wherein the height locking member is extendable to engage the lever between the tip of the lever and the pivot axis of the lever.

* * * * *